US008456087B2

(12) United States Patent
Steere et al.

(10) Patent No.: US 8,456,087 B2
(45) Date of Patent: Jun. 4, 2013

(54) HIGH-PRESSURE SODIUM VAPOR DISCHARGE LAMP WITH HYBRID ANTENNA

(75) Inventors: Thomas G. Steere, Hornell, NY (US); Godfried Cornelius Gerardus Maria Manders, Susteren (NL); Gerardus Marinus Josephus Francis Luijks, Nuenen (NL); Chantal Sweegers, Heeze (NL); Johan Leopold Victorina Hendrix, Zandhoven (BE); Paulus Adrianus Hypolytus Jozef Huijbrechts, Breda (NL); Wilhelmus Johannes Jacobus Welters, Weert (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 180 days.

(21) Appl. No.: 13/003,475

(22) PCT Filed: Jun. 26, 2009

(86) PCT No.: PCT/IB2009/052766

§ 371 (c)(1),
(2), (4) Date: Jan. 10, 2011

(87) PCT Pub. No.: WO2010/004472

PCT Pub. Date: Jan. 14, 2010

(65) Prior Publication Data

US 2011/0115371 A1 May 19, 2011

Related U.S. Application Data

(60) Provisional application No. 61/171,269, filed on Apr. 21, 2009, provisional application No. 61/079,514, filed on Jul. 10, 2008.

(51) Int. Cl.

| | |
|---|---|
| ***H01J 17/44*** | (2006.01) |
| ***H01J 61/54*** | (2006.01) |
| ***H01J 17/30*** | (2006.01) |

(52) U.S. Cl.
USPC ..... 313/594; 313/595

(58) Field of Classification Search
None
See application file for complete search history.

(56) References Cited

U.S. PATENT DOCUMENTS

| | | | |
|---|---|---|---|
| 4,260,929 | A | 4/1981 | Jacobs |
| 6,051,927 | A | 4/2000 | Graser |
| 6,054,810 | A | 4/2000 | Yamamoto |
| 6,172,462 | B1 | 1/2001 | Gibson |
| 6,538,377 | B1 | 3/2003 | Scott |
| 6,943,498 | B2 | 9/2005 | Nishiura |
| 7,230,389 | B2 | 6/2007 | Takeda |
| 2005/0042967 | A1 | 2/2005 | Jackson |

FOREIGN PATENT DOCUMENTS

| | | | |
|---|---|---|---|
| DE | 19901987 | A1 | 7/2000 |
| EP | 0002848 | A1 | 7/1979 |
| EP | 0360326 | A1 | 3/1990 |
| EP | 0364014 | B1 | 4/1990 |
| EP | 0592040 | A1 | 4/1994 |
| EP | 0834905 | A2 | 4/1998 |
| EP | 0944111 | A1 | 9/1999 |
| EP | 1355345 | A1 | 10/2003 |
| JP | 52118978 | A1 | 10/1977 |
| JP | 03004439 | A1 | 10/1991 |
| WO | 2005027183 | A2 | 3/2005 |

*Primary Examiner* — Britt D Hanley

(57) ABSTRACT

A discharge lamp includes a body portion having inner and outer body walls and first and second ends. The inner body wall defines at least part of a cavity located between the first and second ends. First and second end parts have inner end-part and outer end-part walls and a hole extending between the inner end-part wall and the outer end-part wall. The first and second end parts are each located, at least in part, within the cavity and separate from each other so as to maintain a gas under pressure. First and second electrodes are included in the cavity. An antenna has first and second antenna ends and is formed on the outer body wall of the body portion and the outer end-part wall of at least one of the first and second end parts. The antenna is not directly connected to the first and second electrodes.

42 Claims, 19 Drawing Sheets

700

1100

1200

HIGH-PRESSURE SODIUM VAPOR DISCHARGE LAMP WITH HYBRID ANTENNA

The present system relates generally to high-pressure discharge lamps (HID), such as high-pressure sodium (HPS) vapor discharge lamps, and, more particularly, to an HID or HPS vapor discharge lamp having an integrated hybrid ignition antenna (IA or antenna) which enhances a starting operation of the lamp, and a method of forming and operating the lamp.

Typically, to improve lighting performance factors such as luminous intensity, or photon flux per watt of power, of a typical HPS-type lamp (hereinafter HPS lamp), a higher internal gas (e.g., Xe, etc.) pressure is used. However, because of this higher internal gas pressure, a larger ignition pulse is required to initially strike or ignite the lamp. Accordingly, lighting fixture components such as, for example, an igniter, a socket, etc., must be able to withstand this larger ignition pulse. Unfortunately, this larger ignition pulse can often exceed the operating range of conventional lighting fixture components. For example, a lighting fixture may have converters, ballasts, igniters, sockets, wires, etc., which are rated not to exceed a voltage which is less than that of this larger ignition pulse. Unfortunately, replacement of lighting fixtures and/or their components (e.g., converters, ballasts, bulb sockets, wiring, etc.) may not be feasible because of cost and/or other constraints (e.g., design, physical placement, etc.).

One way to solve this problem is to lower the ignition pulse of the HPS lamp. Accordingly, the distance between electrodes may be reduced and/or an ignition aid such as a starting or ignition antenna (hereinafter antenna) may be used. Unfortunately, reducing the distance between the electrodes would also reduce the output and efficiency of the HPS lamp. Therefore, the antenna is often the method of choice.

With regard to the antenna, two main types are conventionally known, namely, active and passive antennas. The active antenna is electrically connected to an electrode of the HPS lamp (e.g., by using a wire lead, etc.), while the passive antenna electrically floats relative to one or more electrodes of an HPS lamp.

A graph illustrating ignition pulse values for conventional Xe gas lamps using passive or active antennas at a given gas pressure is shown in FIG. 1. With reference to Graph 100A, a boxplot graph of ignition pulse voltages for a 400-watt, 150-torr, Xe HPS lamp using active or passive antennas is shown. As illustrated in Graph 100A, the HPS lamp using the active-type antenna requires a smaller ignition pulse (with a narrower range), while a similar HPS lamp with a passive antenna requires a larger ignition pulse (with a broader range). This difference between ignition pulse values for passive and active antennas is maintained through a broad internal gas (e.g., Xe) range and is better illustrated with reference to Graph 100B, which illustrates pulse heights or amplitude values for 400-watt lamps with active or passive antennas at various gas (i.e., Xe) pressures.

A graph illustrating ignition pulse values for conventional Xe gas lamps using passive or active antennas at various gas pressures is shown in FIG. 1B. With reference to Graph 100B, it is seen that a lamp using an active antenna requires a smaller ignition pulse than a similar lamp using a passive antenna. Although active antennas typically require a smaller ignition pulse than passive antennas, they have several disadvantages. First, as illustrated in U.S. Pat. No. 4,260,929, entitled "High-Pressure Sodium Vapor Discharge Lamp," to Jacobs et al., which is incorporated herein by reference in its entireties, active antennas and/or their electrical connectors are typically not formed integrally with arc tubes, and thus require additional "mount" components which may increase costs and manufacturing complexity. Further, because active antennas are electrically connected to an electrode of a lamp and are at the same potential or voltage as the electrode, the charges (e.g., negative charges) on the active antennas tend to draw ions in the lamp, e.g., positive sodium ions, through the wall of the lamp resulting in sodium loss. This sodium migration or loss can adversely affect illumination characteristics and/or cause premature lamp failure.

Accordingly, in order to reduce sodium migration or loss (as well as costs and manufacturing complexity), a passive antenna is typically used. A well-known passive antenna is disclosed in EP 0592040 and U.S. Pat. No. 5,541,480, which are each incorporated herein by reference in its entirety. However, as discussed above, passive antennas typically require a larger ignition pulse, which, depending upon lamp design parameters such as gas pressure (e.g., xenon (Xe) pressure) within the arc tube, may necessitate replacement of conventional fixtures and/or their components (e.g., to handle the higher voltage). Thus, a higher-pressure arc tube with a passive antenna may not be suitable as a "direct-fit" replacement lamp. Accordingly, there is a need for a higher-pressure (e.g., HPS) lamp with enhanced illumination characteristics and a low ignition pulse rating.

Further, conventional active and/or passive antennas typically require additional components (e.g., wire leads, etc.), which can increase manufacturing costs and complexity. Additionally, these additional components can reduce reliability of the lamp.

A graph which illustrates photon flux attainable at very high Xe pressures for a conventional 400-watt HPS lamp (at various Xe pressures) is shown in FIG. 1C. With reference to Graph 100C, the photon flux (which is commonly used in horticultural applications) attainable at very high Xe pressures is shown. With an Xe gas pressure of 450 to 550 torr as shown, photon flux values can exceed what is currently limited to 1.5 micromol per watt for conventional 400-watt HPS lamps.

Thus, because of their lower ignition pulse requirements, active antennas are typically preferred over passive antennas. However, because of their reduced life and added cost, and complexity, a new type of antenna is desirable.

Accordingly, there is a need for an ignition antenna capable of reducing the magnitude of an ignition pulse that is required to initially strike or ignite a gas or HID lamp, such as an HPS lamp having a high gas (e.g., Xe) pressure in the arc tube. Moreover, there is a need for an antenna with reduced manufacturing costs and complexity. Further, there is a need for an antenna which can increase the reliability of an HPS lamp and reduce a number of necessary components of a mount within a bulb which uses the HPS lamp.

Further, there is a need for an antenna which can reduce the magnitude of an ignition pulse required to strike an HPS lamp so that a higher pressure can be used within an arc tube of the lamp, and so that luminous efficiency of the HPS lamp can be increased. Additionally, higher photon flux values may also be attained, which can be beneficial when using, for example, agricultural (e.g., AGRO)—type lamps. Accordingly, a "direct-fit" higher-pressure HPS lamp can be used with conventional lighting fixture components, without the need to change and/or redesign lighting fixture components.

One object of the present systems, methods, apparatus and devices is to overcome the disadvantages of conventional systems and devices. According to one illustrative embodiment, a discharge lamp includes a body portion having inner and outer body walls and first and second ends. The inner body wall defines at least part of a cavity located between the first and second ends. First and second end parts have inner end-part and outer end-part walls and a hole extending between the inner end-part wall and the outer end-part wall. The first and second end parts each are located, at least in part, within the cavity and separate from each other so as to maintain a gas under pressure. First and second electrodes are included in the cavity. An antenna has first and second antenna ends and is formed on the outer body wall of the body portion and the outer end-part wall of at least one of the first and second end parts. The antenna is not directly connected to the first and second electrodes.

The present systems, methods, apparatus and devices allow reducing an ignition pulse of a lamp, such as an HPS lamp using a hybrid antenna, for example. It should be understood that although HPS lamps are described herein as an exemplary embodiment, the present systems, methods, apparatus and devices are equally applicable to any other discharge lamps, such as CDM (ceramic discharge metal halide lamps), and the like. Accordingly, the lamp, e.g., an HPS lamp, may be filled with an inert gas (e.g., Ar, Xe, Ne, etc.) using a pressure which may enhance luminous efficiency and photon flux values of the HPS lamp, while using conventional lighting fixtures.

Further areas of applicability of the present devices and systems and methods will become apparent from the detailed description provided hereinafter. It should be understood that the detailed description and specific examples, while indicating exemplary embodiments of the systems and methods, such as HPS lamps, are intended for purposes of illustration only and are not intended to limit the scope of the invention. Accordingly, the present systems, methods, apparatus and devices are equally applicable to non-HPS lamps, such as any other discharge lamps, e.g., CDM lamps and the like.

These and other features, aspects, and advantages of the apparatus, systems and methods of the present invention will become better understood from the following description, appended claims, and accompanying drawing where:

The following description of certain exemplary embodiments is merely exemplary in nature and is in no way intended to limit the invention, its applications, or uses. In the following detailed description of embodiments of the present systems and methods, reference is made to the accompanying drawings which form a part hereof, and in which are shown by way of illustration specific embodiments in which the described systems and methods may be practiced. These embodiments are described in sufficient detail to enable those skilled in the art to practice the presently disclosed systems and methods, and it is to be understood that other embodiments may be utilized and that structural and logical changes may be made without departing from the spirit and scope of the present system.

The following detailed description is therefore not to be taken in a limiting sense, and the scope of the present system is defined only by the appended claims. The leading digit(s) of the reference numbers in the figures herein typically correspond to the figure number, with the exception that identical components which appear in multiple figures are identified by the same reference numbers. Moreover, for the purpose of clarity, detailed descriptions of certain features will not be discussed when they would be apparent to those with skill in the art so as not to obscure the description of the present system.

Figure 1A:
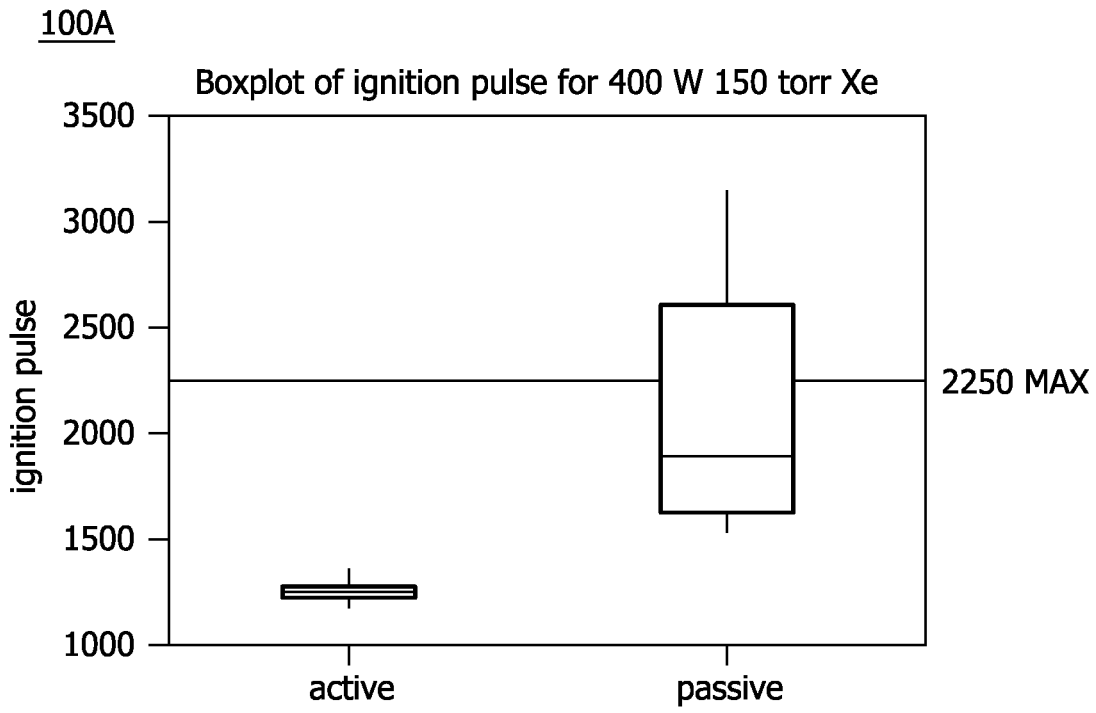
FIG. 1A (PRIOR ART)
FIG. 1A is a graph illustrating ignition pulse voltage values for conventional Xe gas lamps using passive or active antennas at a given gas pressure.
Figure 1B:
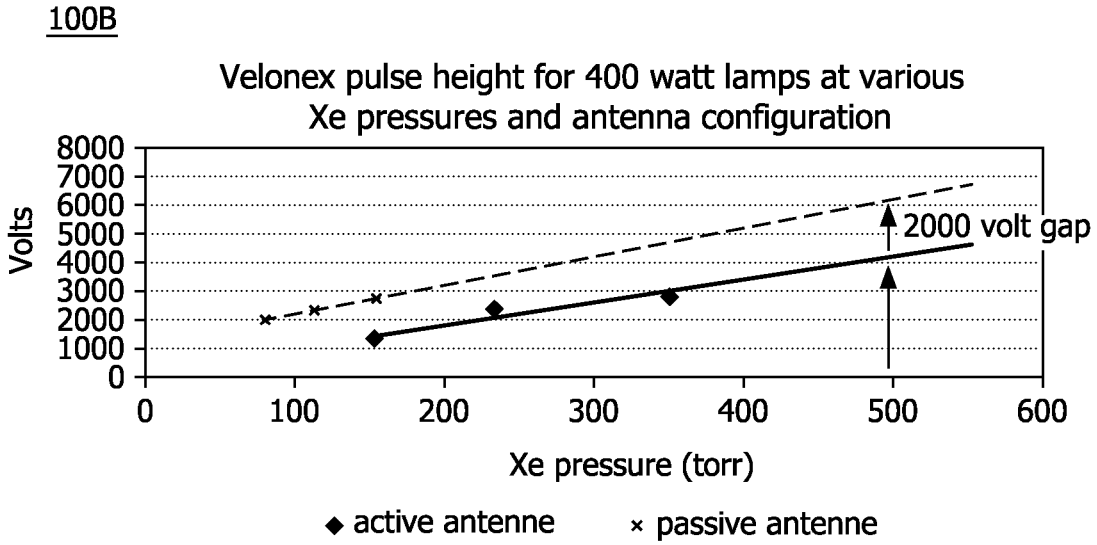
FIG. 1B (PRIOR ART)
FIG. 1B is a graph illustrating ignition pulse voltage values for conventional Xe gas lamps using passive or active antennas at various gas pressures.
Figure 1C:
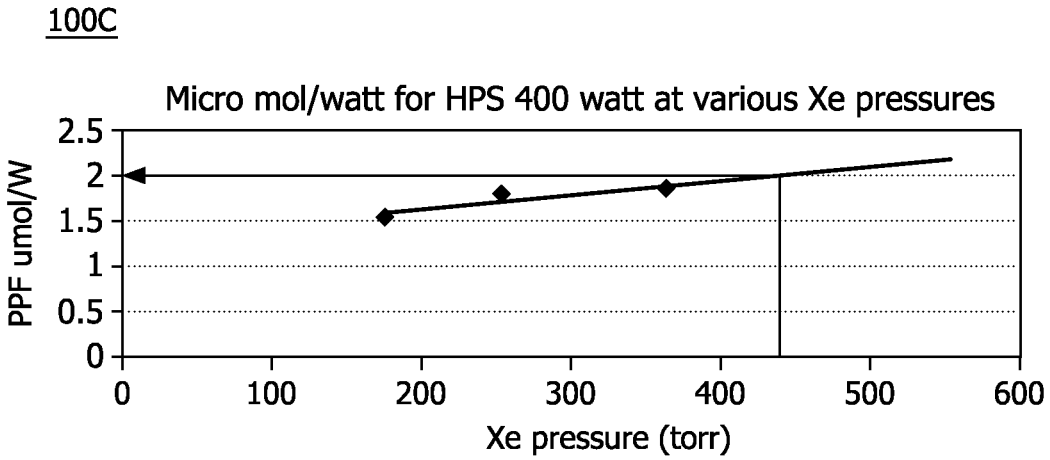
FIG. 1C (PRIOR ART)
FIG. 1C is a graph illustrating photon flux attainable at very high Xe pressures using a conventional 400 watt HPS lamp.
Figure 2:
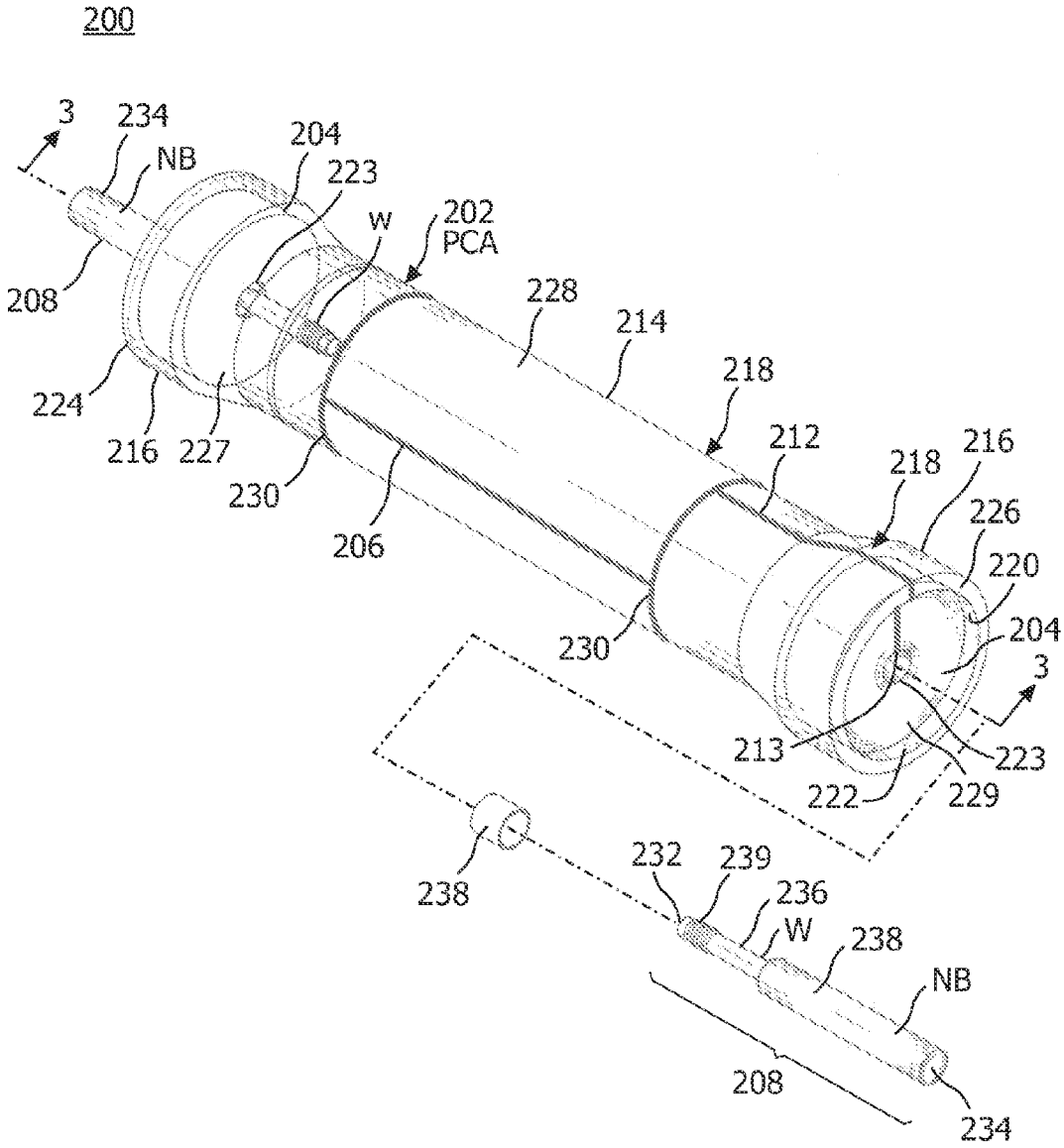
FIG. 2 is a partially-exploded perspective-view illustration of an HPS lamp having an integrated hybrid ignition antenna according to the present invention.

In one embodiment, an HID lamp, such as HPS-type, is provided incorporating an integrated hybrid (ignition) antenna so as to lower ignition pulse values and manufacturing cost and complexity while extending the lamp's expected life cycle. A partially-exploded perspective-view illustration of an exemplary HPS lamp 200 having an integrated hybrid antenna according to one embodiment is shown in FIG. 2. The lamp 200, may include one or more of an arc tube (hereinafter tube) 202, buttons (or plugs) 204, an antenna main part 206, one or more feedthroughs 208, one or more fits 210 (FIG. 3), and an antenna lead 212.

The tube 202 may be formed from polycrystalline alumina (PCA) or other suitable material. The tube 202 has first and second ends 224 and 226, respectively, and an optional cylindrical shape with a center portion 214 situated between end portions 216. The end portions 216 may have a diameter larger than the diameter of the center portion 214. However, it is also envisioned that the diameter of one or more of the end portions 216 may be smaller than or equal to the diameter of the center portion 214. The tube 202 has outer and inner walls 218 and 220, respectively, with the inner wall 220 forming at least part of a main cavity 222. Although a cylindrical tube is shown, it is also envisioned that the tube may have other shapes such as, for example, oval, etc.

Figure 3:
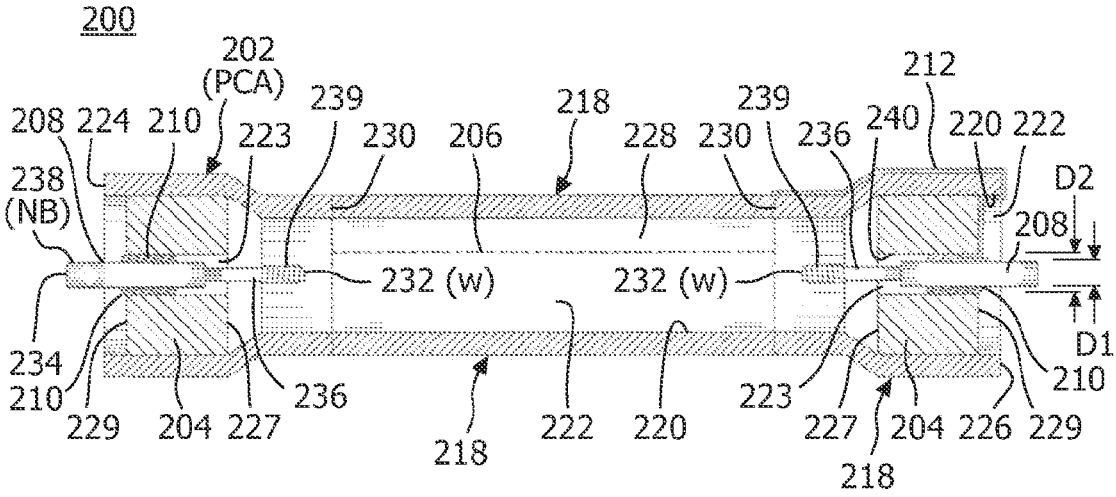
FIG. 3 is a partially-exploded cross-sectional view of the lamp shown in FIG. 2 taken along lines 3-3.

As shown in FIG. 3, the buttons 204 have inner and outer walls 227 and 229, respectively, and button holes 223 (FIG. 4D) which extend between the inner and outer walls 227 and 229, respectively. The buttons 204 are situated at opposite ends of the tube 202 such that a gas cavity 228 is situated there between. The buttons 204 may be placed within the cavity 222 of the tube 202 such that the outer walls 229 of the buttons 204 are recessed from respective ones of the first and second ends 224 and 226, respectively, of the tube 202. However, it is also envisioned that the outer walls 229 of the buttons 204 may fit flush with the first and second ends 224 and 226, respectively, of the tube 202 or may slightly protrude beyond the ends of the first and second ends 224 and 226, respectively, of the tube 202, if desired.

The one or more feedthroughs 208 have first/inner and second/outer ends 232 and 234, respectively, and an optional electrode coil 239 (which is made from a suitable material such as, for example, Tungsten (W)) is situated proximate to the first/inner end 232. The feedthrough 208 may be formed using two or more parts. For example, a first part 236 may be situated proximate to the first end 232 and a second part 238 may be situated, for example, proximate to the second end 234. The first part 236 may include (or be formed from) a material such as, for example, Tungsten and the second part 238 may include (or be formed from) a material such as, for example, Niobium (Nb). The first part 236 and the second part 238 may be attached to each other as shown, or may be coupled to each other using other parts which may include other materials. For example, these other parts may include cermet and/or molybdenum and be situated between the tungsten and niobium areas of the feedthrough 208. The arc tube 200 and portions thereof, e.g., tube 202 and feedthrough 208, may have any desired shape and cross-sections, such as cylindrical, rectangular, etc.

The frit 210 may fully encircle or otherwise surround parts of the feedthrough 208 and is located at least partially within the hole 223 of the button 204 so as to separate the feedthrough 208 from a wall of the hole 223. Accordingly, due to the separation, the end of the antenna lead 212 may be coupled (e.g., capacitively, and/or resistively etc.) to the feedthrough 208. Accordingly, the antenna 206 may have an electrical potential which floats relative to a potential of the corresponding feedthrough 208. The frit may be formed using any suitable insulator such as, for example, glass. The frit should also be able to form a seal between the corresponding button 204 and the feedthrough 208 so that gas is prevented from escaping from the gas cavity 228. Likewise, a suitable seal should be formed between the buttons 204 and the tube 202 so that gas is prevented from escaping from the gas cavity 208.

The antenna 206 may be formed integrally with the tube 202 and extends along a longitudinal part of the tube 202. The antenna 206 may include various shapes and sizes, as desired. For example, the antenna 206 may include end rings 230 which may fully (or partially, if desired) encircle the tube 202, and an antenna lead 212 which may be connected to one of the end rings 230.

The antenna lead 212 may be formed integrally with the tube 202 and the corresponding button 204 and can, for example, couple the antenna 206 to the feedthrough 208 via the frit 210 that separates the antenna lead 212 from the feedthrough 208. Thus, the antenna lead 212 extends between the button 204 and a ring 230 of the antenna 206. Accordingly, as stated above, the antenna lead 212 may have a voltage which may float relative to a voltage of the corresponding feedthrough 208. Accordingly, the antenna 206 (as well as its associated parts such as the rings 230 and the antenna lead 212) may also float which may mitigate sodium attraction and thus, sodium loss from the gas cavity 228 of the tube 202. However, in other embodiments it is envisioned that the feedthrough 208 can be coupled to the antenna lead 212 such that there is a resistance (or conductance) of between, for example, 1-100 Ohms or 25-100 Ohms between the feedthrough 208 and the antenna lead 212 as will be described below with reference to FIGS. 8A-8C.

A partial cross sectional view illustration of the arc tube taken along lines 3-3 of FIG. 2 is shown in FIG. 3. The antenna 206 may be mounted to, or formed upon, the tube 202. The buttons 204 are placed within the cavity 222 and may be slightly recessed from the corresponding first or second ends 224 or 226, respectively, of the tube 202 (as shown). However, it is also envisioned that the buttons 204 may fit flush with, or extend partially from, the corresponding first or second ends 224 and 226, respectively, of the tube 202.

The antenna lead 212 continuously extends between the rings 230 (or the antenna 206) and the hole 223 of a corresponding button 204 along the outer wall 218, the second end 226, and the inner wall 220 of the tube 202, as well as along the outer wall 229 of the button 204. However, depending upon the placement of the button 204 relative to the tube 202, the antenna lead 212 may continuously extend along the outer wall 218 and the second end 226 of the tube 202 and along the outer wall 229 of the button 204. It is also envisioned that the antenna lead 212 may extend along the outer wall 218 of the tube 202 and then along the second end 226 of the button 204.

The antenna lead 212 terminates in the hole 223 of the button 204, and is separated from the feedthrough 208 by the frit 210. Accordingly, there is a gap between the second part 238 (which may be formed from Niobium or other suitable material) of the feedthrough 208 and the end 213 (FIGS. 2, 4D) of the antenna lead 212. In a one embodiment as shown in FIGS. 2, 4C-4E, a diameter D1 of the second part 238 of the feedthrough 208 is about 3.0 mm and an inside diameter D2 of the of the hole 223 of the button 204 is about 3.1 mm.

Accordingly, assuming that the frit 210 is evenly located in the hole 223 around at least a part of the second part 238 of the feedthrough 208, then there should be a gap of about 50−30+50 microns (i.e., substantially between 20-100 microns) between the end 213 of the antenna lead 212 and the feedthrough 208 of the button 204. Although the end 213 of the antenna lead 212 is shown in the hole 223 of the button 204, it is also envisioned that the end 213 of the antenna lead 212 may stop at or near the hole 223 of the button 204, as will be described in connection with FIG. 4E.

Figure 4A:
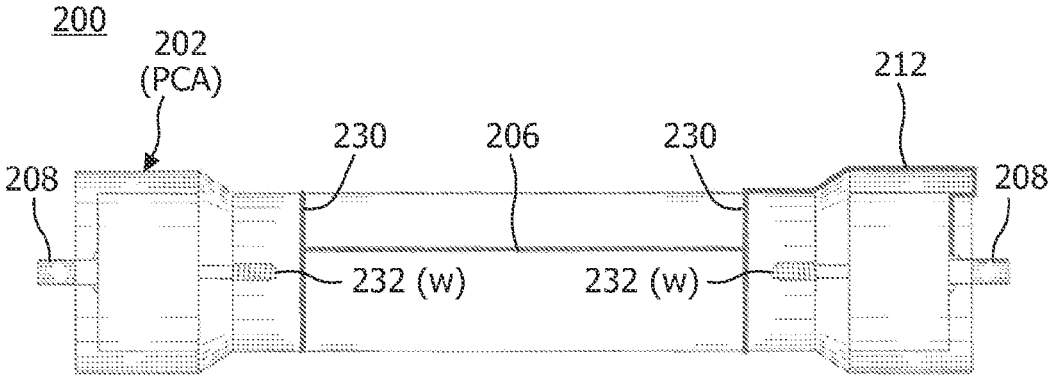
FIG. 4A is a rear planar view illustration of the lamp shown in FIG. 3.

A rear planar view illustration of the lamp shown in FIG. 3 is shown in FIG. 4A. As shown, the antenna 206 includes the lead 212 and optional rings 230. One or more of these parts may be considered to form an antenna. The antenna (or parts thereof) may be formed using a suitable material such as, for example, a refractory material which depending upon embodiment may include one or more of Tungsten, Molybdenum (Mo), Niobium (Nb), Tantalum (Ta), and Rhenium (Re).

Figure 4B:
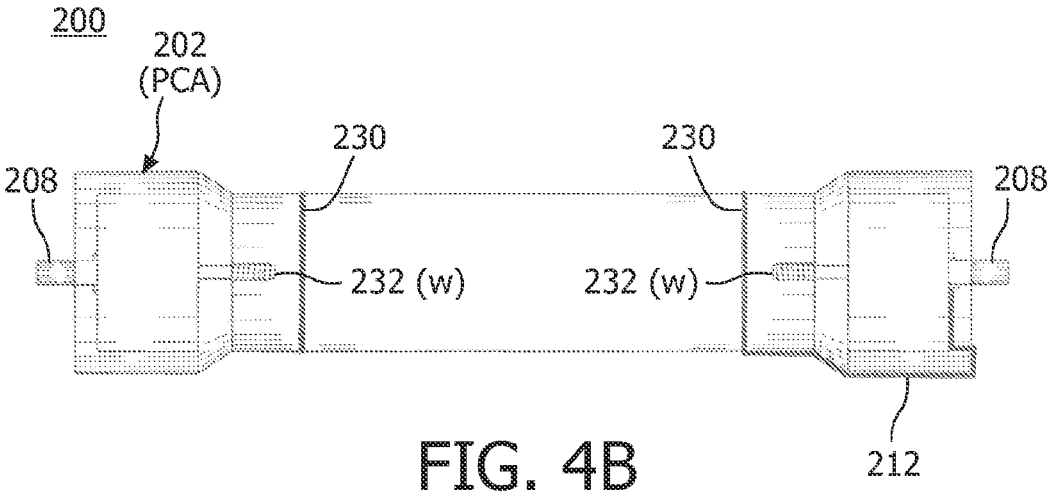
FIG. 4B is a front planar view illustration of the lamp shown in FIG. 3.

A front planar view illustration of the lamp shown in FIG. 3 is shown in FIG. 4B.

Figure 4C:
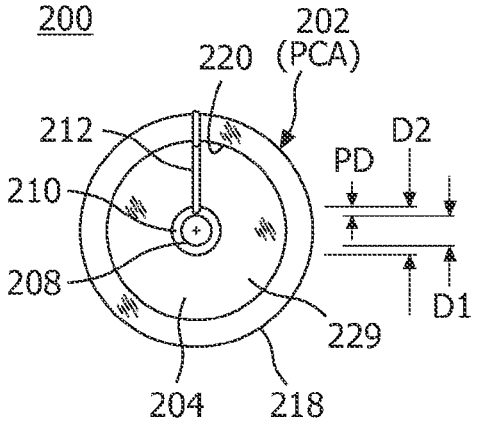
FIG. 4C is a planar end-view illustration of the lamp shown in FIGS. 2 and 3.

A planar end-view illustration of the lamp shown in FIGS. 2 and 3 is shown in FIG. 4C. The frit 210 separates the feedthrough 208 from the inner wall 240 (FIGS. 4D-4E) of the button 204 and the antenna lead 212 formed on the inner wall 240. The antenna lead 212 continuously extends radially from the inner wall 240 of the button 204 along the exterior wall 229 of the button and then extends along the inner wall 220, the second end 226, and the outer wall 218 of the tube 202.

Figure 4D:
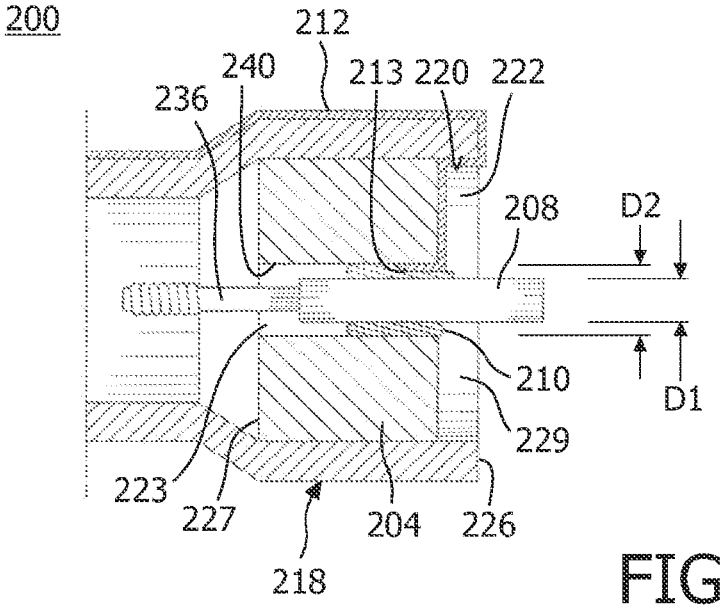
FIG. 4D is a detailed partial cross sectional view illustration of an end of the lamp shown in FIG. 4A.

A detailed partial cross sectional view illustration of an end of the lamp shown in FIG. 4A is shown in FIG. 4D. The area of the antenna that is at, or in, the hole is separated from the feedthrough 208 by a distance of ½ of D2-D1. In one embodiment, the end 213 of the antenna 212 may be located anywhere within the hole 223 of the button 204. Although the antenna 212 is shown having a thickness, this is for illustration only. In actual implementation, the antenna is located on the surface of the button 204 and does not significantly affect the thickness of the frit 210 as shown. Thus, the antenna 212 is separated from the feedthrough 208 by a predetermined distance PD, shown in FIG. 4C.

Figure 4E:
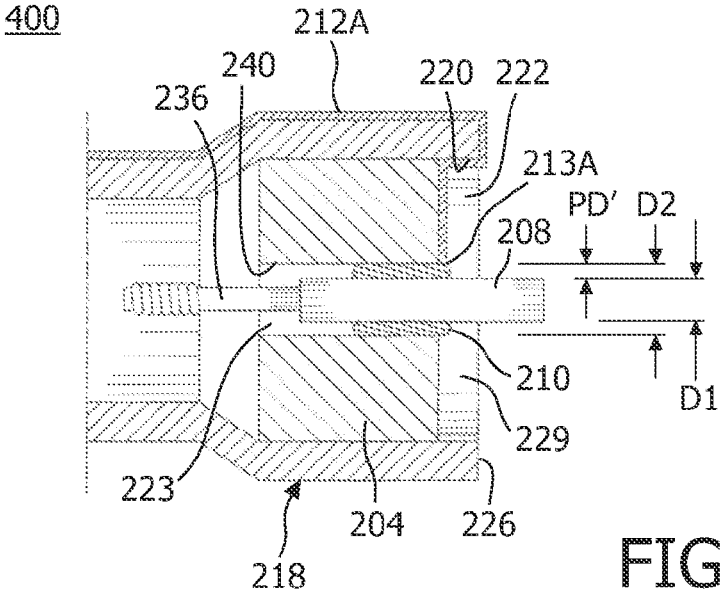
FIG. 4E is a detailed partial cross sectional view illustration of an alternative antenna end.

A detailed partial cross sectional view illustration of an alternative antenna end is shown in FIG. 4E. The arc tube 400 is similar to the arc tube 200 shown in FIGS. 2-4D. However, an end 213A of the antenna 212A is located at the hole 223 of the button 204 and does not significantly enter the hole 223 of the button 204. Thus, the antenna 212A is separated from the feedthrough 208 by a predetermined distance PD'.

Figure 5:
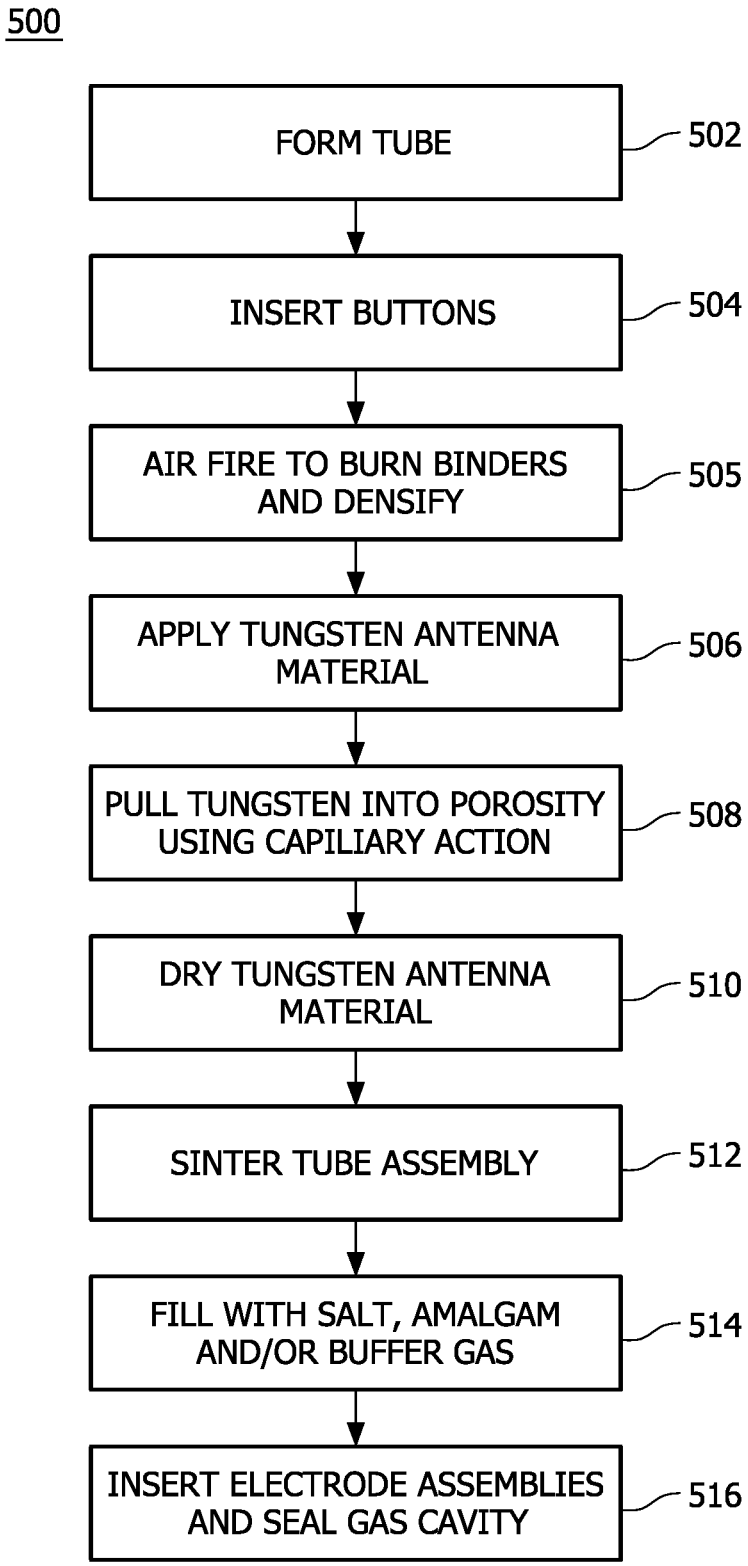
FIG. 5 is a flow chart corresponding to a process for forming the arc tube according to the present invention.

A process for forming the lamp according to the present invention will now be described. A flow chart corresponding to a process for forming the lamp according to the present invention is shown in FIG. 5. Process 500 may be controlled by one more computers communicating over a network (not shown). The process 500 may include one or more of the following steps, acts or operations. Further, one or more of these acts may be combined and/or separated into sub-acts, if desired. In act 502, a tube is formed using a material such as, for example, an alumina material. The tube may be formed using any suitable method such as, for example, extrusion, injection molding, slip casting, etc. After completing act 502, the process continues to act 504.

In act 504, one or more of buttons are inserted at least in part within a cavity of the tube, e.g., after the tube is extruded, and is attached and sealed to the tube by, for example, sintering the tube. After the one or more buttons are secured to the tube, the process continues to act 505. Although the one or more buttons are secured to the tube in act 505, in other embodiments it is also envisioned that the buttons may be formed integrally with the tube. Further, it is also envisioned that the one or more buttons may be secured to the tube by other methods. For example, injection molding and slip casting methods may be used.

In act 505, the alumina is subjected to air firing at 1200-1450 degrees C. (or other suitable temperature) so as to burn organic binders from the formed shape of the tube and/or to densify the material so that the formed shape maintains its integrity during application of a tungsten antenna material in act 506. After completing act 504 and allowing the tube to cool, the process continues to act 506.

In act 506, the tungsten antenna material is applied to the tube using any suitable method. For example, the tungsten material may include a paste (or other suitably flowing or applicable material) which includes a mixture of, for example, tungsten, alumina and/or organic material. The paste may be applied to one or more surfaces (e.g., inner, outer, and/or an end) of the tube using any suitable method. For example, the paste may be applied using an ink-jet printing technique, a pressure applicator (e.g., a syringe, etc.), spreading using a brush, etc., and/or combinations of these techniques. After applying the paste, the tungsten material should form a continuous line along the outside surface of the one end of the tube to an inside hole located at an opposite end of the tube. After completing act 506, act 508 is performed.

In act 508, the tungsten paste is "pulled" into the porosity of the formed alumina material of the tube by a few microns through capillary action which may take less than five minutes, for example. After completing act 508, act 510 is performed.

In act 510, organics from the tungsten paste are dried and the process continues to act 512.

In act 512, the tube (which is now considered a tube assembly) is subject to a sintering process at a suitable atmosphere and temperature. For example, a suitable temperature is between 1800-1950 degrees C. under hydrogen or vacuum with an appropriated dew point to form a polycrystalline alumina (PCA) shape with the tungsten (formerly paste) forming an electrically continuous line along its entire length (e.g., even between edges where materials or parts change—such as, for example, where the button and the PCA meet). However, other temperatures are also envisioned. As a result of the sintering process, the tungsten becomes interlocked with the alumina at the surface of the PCA a few microns deep into the surface of the PCA. After completing act 512, the process continues to act 514.

In act 514, an internal mixture and a suitable buffer gas are placed within the cavity of the tube. The internal mixture can include, for example, a salt, an amalgam, etc. The suitable buffer gas, may include, a Noble gas such as, for example, one or more of Argon, Xenon, Neon, and/or combinations thereof, etc. The internal mixtures of salt, amalgam, etc., may be placed into the cavity through one or more of the button holes. However, it is also envisioned that the internal mixtures may be placed into the tube via an open end of the tube and then a button (which can include a feedthrough) of the one or more buttons can be connected to the tube. The process then continues to act 516.

In act 516, an electrode assembly (i.e., a feedthrough) may be inserted into each hole of the PCA assembly/buttons and sealed using a glass frit at a temperature of about 1150-1300 degrees C. or other suitable temperature. The electrode that is adjacent to the tungsten antenna lead 212 (that is located along the surface of the corresponding hole through which the antenna passes) does not contact the tungsten antenna.

Rather, the electrode is separated from the tungsten by a gap of about 50–30+50 microns (although other distances are also envisioned). This gap may be filled using an insulating material such as, for example, glass so as to form a glass frit. The PCA tube assembly is now complete. It can be used "as is" or incorporated within a lamp assembly as will be shown in FIG. 6. In some embodiments, the frit may include any other desired material such as Barium or other conductors to change, e.g., reduce the resistivity or insulating properties of the frit.

In operation, when an applied starting voltage is applied across the electrodes, where electrons need to jump only the 50-100 micron gap from a corresponding electrode to the tungsten antenna and thereafter jump to an opposite electrode, thus reducing the voltage required to initiate this jump compared to using a passive antenna only. Thus, by minimizing the distance electrons must jump from electrode to electrode during a start operation, a lower ignition pulse rating may be obtained. Accordingly, the antenna of the present invention may be considered a capacitively-coupled "hybrid-type" floating antenna.

Figure 6:
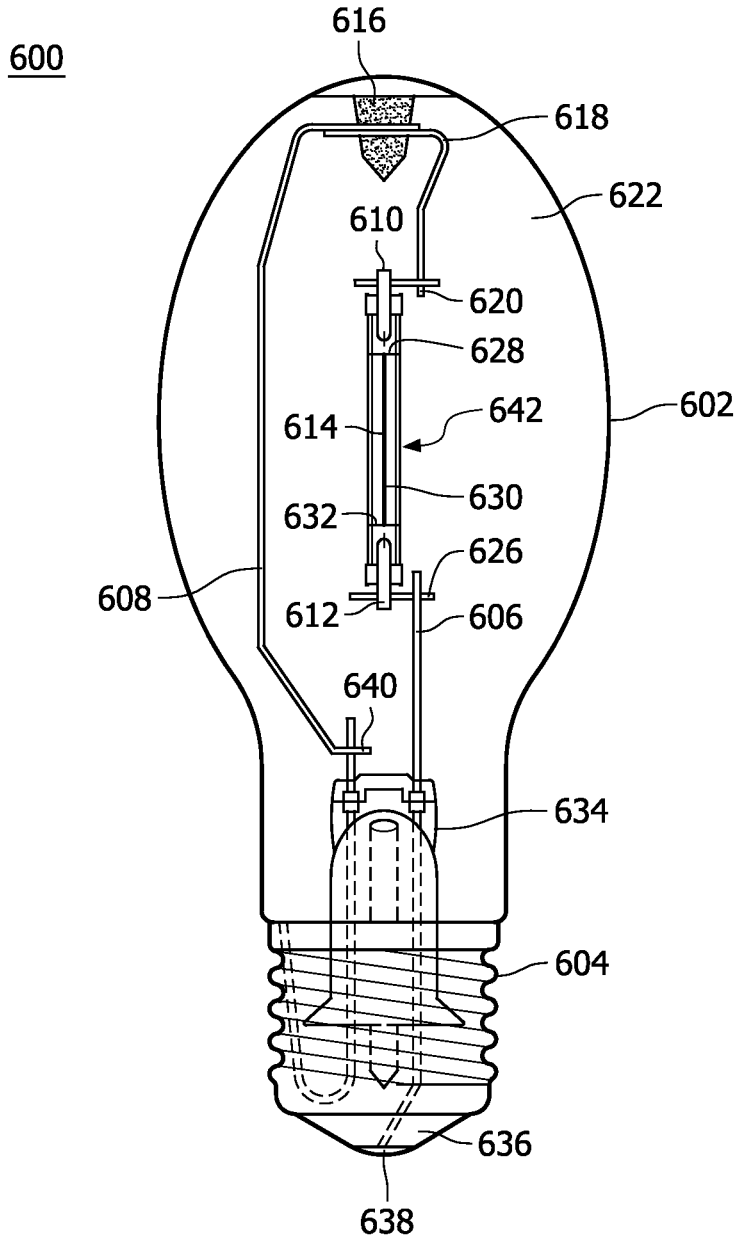
FIG. 6 is a planar side-view illustration of a lamp assembly including the arc tube according to the present invention.

A planar side-view illustration of a lamp assembly including the lamp according to the present invention is shown in FIG. 6. The lamp 600 may include one or more of an outer envelope 602, a base 604, first and second stem leads 606 and 640, respectively, a (glass) stem 634, a wire frame 608, a dimple 616, and an illumination source such as, for example, an arc tube lamp 642 (hereinafter lamp 642) which may be similar to the lamp 200. In one embodiment, the orientation of the arc tube end 226 is toward the dome end of the lamp, but may be toward the base end of the lamp as well.

The outer bulb 602 may be formed from glass or other suitable material and is attached to a suitable base such as, for example, a threaded base 604. However, other bases, such as, for example, mini can, double contact bayonet, medium and mogul bipost, recessed single contact, pin bases PG-12 etc. are also envisioned. The outer bulb 602 forms at least part of a cavity 622 in which the lamp 642 is located.

The lamp 642 includes an arc tube 630 (which may be formed from a PCA or other suitable material), first and second feedthroughs 612 and 610, respectively, and a hybrid antenna 614 that has an end which is located at (e.g., substantially near or in) a hole through which a corresponding feedthrough passes (not shown).

The first and second stem leads 640 and 606, respectively, may be formed from a conductive material such as any type of steel, for example. The first and second stem leads 640, 606 may be coupled to the base 604 and a conductive center contact 638, respectively, at their first ends. The second stem lead 606 may also be coupled to an extension 626 which is coupled to the feedthrough 612 of the lamp 642. The first stem lead 640 may be coupled to the wire frame 608 which may include an end portion 618. A locator such as, for example, a dimple 606 can be used to correctly locate the wire frame 608 relative to the outer bulb 602. Accordingly, the wire frame 608 may include a hole (not shown) in which at least part of the dimple 616 may be placed. However, it is also envisioned that a locator may be placed around the wire frame 608, if desired. The end portion 618 of the wire frame 608 may be coupled to an extension 620 which is coupled to the second feedthrough 610 of the lamp 642.

The stem 634 forms at least part of the cavity 622 and provides a passage (and a seal) for the first and second stem leads 640 and 606, respectively, which pass therethrough. An insulator 636 may be used to insulate the center contact 638 from the metal base 604.

The lamp 642 may be held in position by any suitable method. For example, feedthroughs 610 and 612 may be respectively coupled to extensions 620 and 626 which hold the lamp 642 in position.

Thus, according to the present systems and devices, a high-pressure, low-cost, reliable, and easily-ignited HPS-type bulb that may be started using a low-power ignition pulse is provided.

Figure 7:
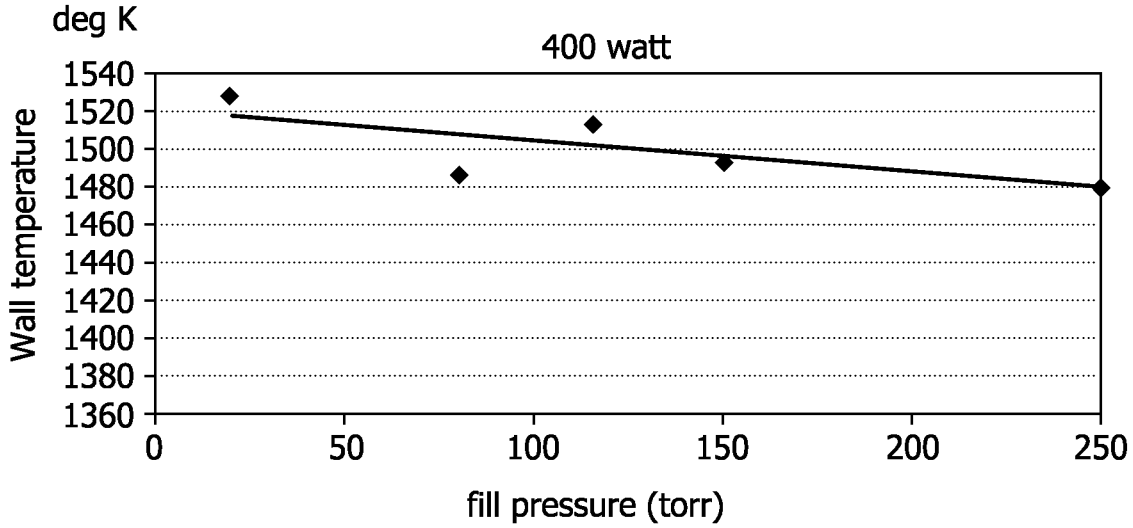
FIG. 7 is a graph illustrating exemplary PCA tube wall temperatures (in degrees Kelvin) with respect to fill pressure (in torr) for an arc tube lamp according to the present invention.

A graph illustrating exemplary PCA tube wall temperatures with respect to fill pressure for an arc tube lamp according to the present invention is shown in FIG. 7. Graph 700 illustrates a decrease in wall temperature as fill pressure is increased for a 400 watt arc tube lamp according to the present invention. As the temperatures of gas lamps may be dependent upon many factors such as, for example, tube wall thickness, etc., the temperatures shown graph 700 are merely exemplary in nature. Accordingly, as other temperatures for a given pressure range are also envisioned, the present invention is not limited the temperature/pressure range as shown in FIG. 7.

Figure 8A:
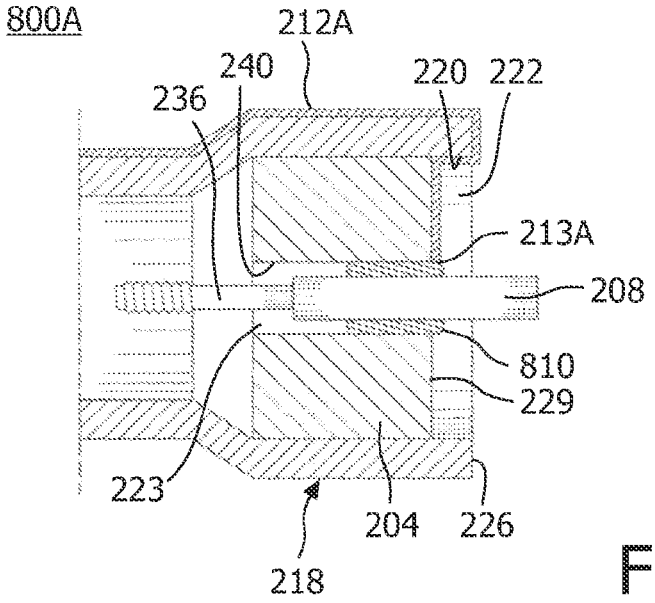
FIG. 8A is a detailed partial cross sectional view illustration of an end of the lamp according to the present invention with a conductive frit.

A detailed partial cross sectional view illustration of an end of the lamp according to the present invention with a conductive frit is shown in FIG. 8A. Arc tube 800A is similar to the arc tube 200 shown in FIGS. 2-4D. However, a frit 810 may include a conductive material such as, for example, Barium, Dysprosium, Aluminum, etc., and therefore may have a predetermined resistive value. Accordingly the antenna 212A may be coupled to the feedthrough 208 via this predetermined resistance. This predetermined resistance may be less than, for example, 100 Ohms. However, it is also envisioned that the resistance of the frit 810 may be greater than 100 Ohms.

It yet other embodiments, it is envisioned that the frit may include one or more materials and/or layers so that it may have a desired thermal expansion coefficient or thermal expansion. For example, the thermal expansion coefficient may be adjusted so that that a thermal expansion of the combination formed by the frit and/or the feedthrough is in accordance with (or matches) a thermal expansion of a corresponding hole of a button through which the feedthrough passes. Accordingly, by controlling thermal expansion of the frit, the thermal expansion of the combination formed by the feedthrough and/or the frit may closely match a thermal expansion of the hole during operation of the lamp and/or when the lamp is off. This can reduce stress between components of a lamp and/or enhance sealing of gasses within the arc tube 800A.

Figure 8B:
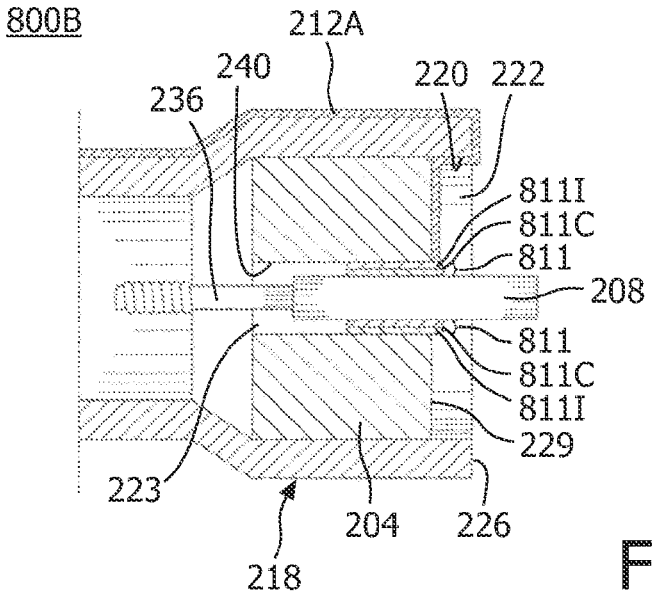
FIG. 8B is a detailed partial cross sectional view illustration of an end of the lamp with a partially conductive frit.

A detailed partial cross sectional view illustration of an end of the lamp with a partially conductive frit is shown in FIG. 8B. Arc tube 800B is similar to the arc tube 200 shown in FIGS. 2-4D and 8A. However, a frit 811 may include a conductive part (or parts) 811C and one or more insulating parts 811I. The conductive part 811C may include a conductive material such as, for example, Barium, Dysprosium, Aluminum, etc., and therefore may have a predetermined resistive value and/or thermal expansion coefficient. When the resistance of conductive part 811C of the frit 811 is greater than (or equal to) are predetermined value (e.g., 10 ohms although other values are also envisioned), the frit 811 may include the insulating part 811I to provide an insulating layer between the antenna 212A and the feedthrough 208. The one or more insulating parts 811I may include, for example, a material (e.g., glass, ceramic, etc.) having a desired insulating characteristic and/or thermal expansion coefficient. Thus, the frit 811 (or parts thereof) may include a predetermined resistive part (or parts) and an insulating part (or parts). Accordingly, the antenna lead 212A can be coupled to the feedthrough 208 via the frit 811. Further, the frit 811 may form at least part of a capacitor for coupling the antenna to the feedthrough.

Figure 8C:
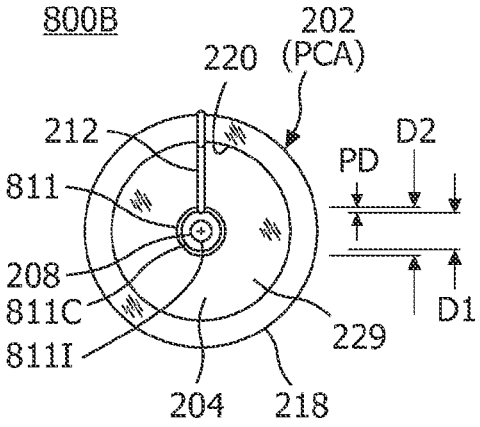
FIG. 8C is a planar end-view illustration of the lamp shown in FIG. 8B.

A planar end-view illustration of the lamp shown in FIG. 8B is shown in FIG. 8C. The insulating layer 811I is situated between an antenna lead 812A and the feedthrough 208. Although the insulating part 811I is shown adjacent to an inner wall of the button hole 223, it is also envisioned that the insulating part 811I may be adjacent to the feedthrough 208 or may be sandwiched between conducting parts of the frit. Likewise, a conductive part of the frit may be situated between insulating parts of the frit.

Although, the antenna 212A is shown in FIGS. 8A-8C, an antenna 212 having an end as shown in FIG. 4D may also be used.

A further feature of the present systems and devices is to provide an HPS-type lamp which may be filled with a higher gas (e.g., Xe) pressure so as to enhance luminous efficiency and photon flux values of the HPS-type lamp, and reduce the operating wall temperature of the PCA arc tube, as shown in FIG. 7, thus prolonging life while using conventional lighting fixture components. Thus, conventional lamps in, for example, commercial settings such as, greenhouses, may be easily updated to provide enhanced lighting levels thereby increasing plant growth and gains in efficiency.

Figure 9:
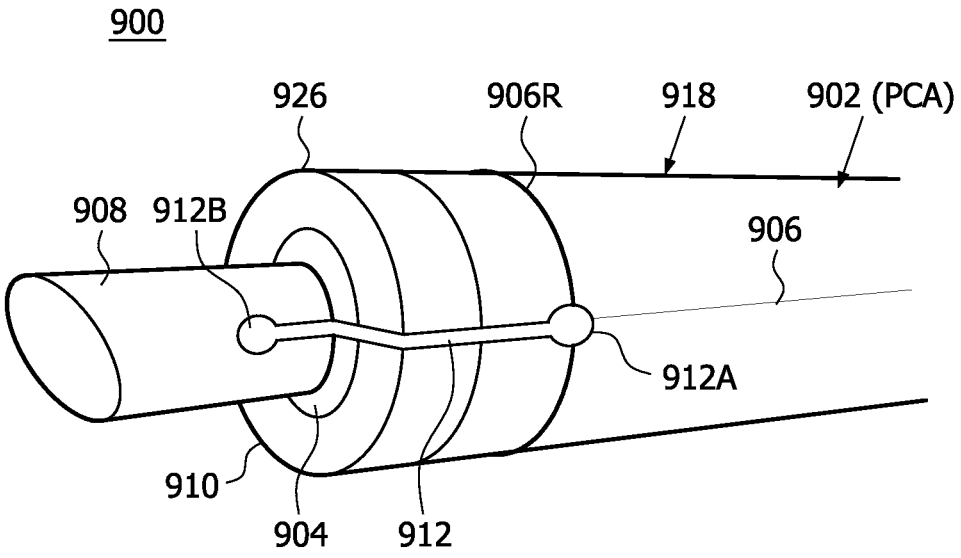
FIG. 9 is a perspective-view illustration of an end of an HPS lamp having an integrated ignition antenna according to the present system.

FIG. 9 is a perspective-view illustration of an end of an HPS lamp having an integrated ignition antenna according to the present system. The lamp 900, may include one or more of an arc tube 902, one or more buttons 904, an antenna 906, one or more feedthroughs 908, one or more seals 910, and an antenna lead 912. The arc tube 902 may have one or more ends 926, and an optional cylindrical shape defining outer and inner walls 918 and 220, respectively. The HPS lamp 900 may be similar to the HPS lamp shown in FIG. 2 with a difference being that the antenna lead 912 has an end 912B which may end at, and be coupled to, one of the one or more feedthroughs 908. The antenna lead 912 may be formed from any suitable material such as, for example, Tungsten (W), Antimony Tin Oxide (ATO), etc., and may be formed upon and/or extend across one or more of the ends 926 of the arc tube 902, one of the one or more buttons 904, and/or the seal 920. The seal 910 may include any suitable frit material as described elsewhere in this document. The antenna 906 may be similar to the antenna 206 and may include one or more rings 906R and/or a main part 906M. The antenna 206 may include the antenna lead 212 and/or shaped elements such as, for example, an antenna ring 206R.

Figure 10A:
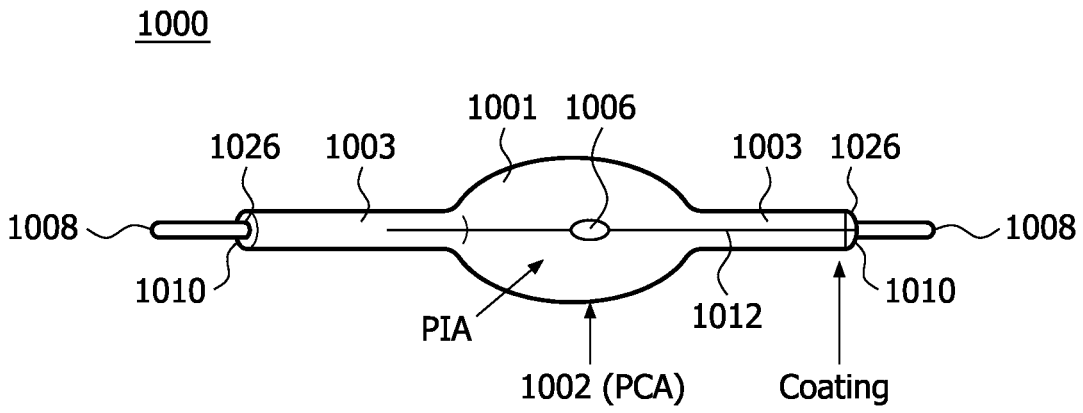
FIG. 10A is a perspective-view illustration of a shaped CDM lamp having an integrated ignition antenna according to the present system.

FIG. 10A is a perspective-view illustration of a shaped CDM lamp having an integrated ignition antenna according to the present system. The lamp 1000, may include one or more of an arc tube 1002, one or more buttons, an antenna 1006, one or more feedthroughs 1008, one or more seals 1010. The arc tube 1002 may have one or more ends 1026, and an optional shaped center portion 1001 that may be situated between neck portions 1003. The antenna 1006 may include an antenna lead 1012 which may be formed integrally with the antenna 1006. The antenna lead 1012 may be deposited upon, and extend across, a surface of one of the seals 1010 and may couple the antenna 1006 to one or more of the feedthroughs 1008.

Figure 10B:
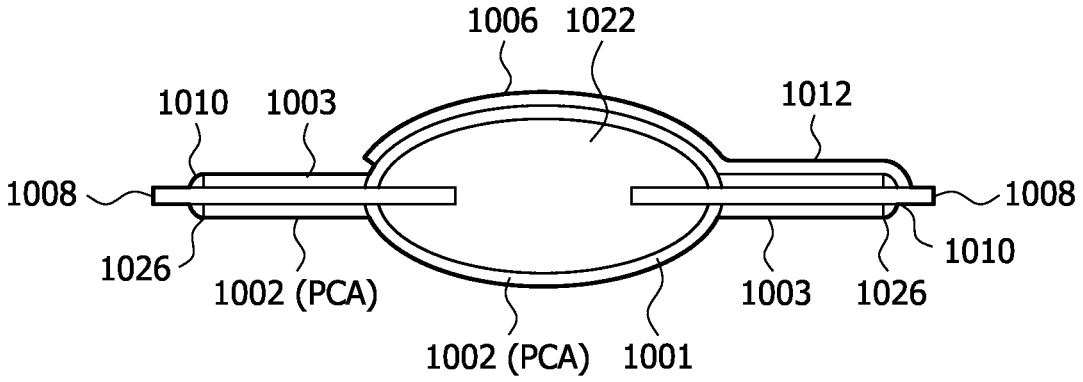
FIG. 10B is a detailed partial cross sectional view illustration of the lamp shown in FIG. 10A.

FIG. 10B is a detailed partial cross sectional view illustration of the lamp shown in FIG. 10A. The antenna lead 1012 is formed upon the arc tube 1002, extends across the seal 1010, and is coupled to the feedthrough 1008. Accordingly 1008. Accordingly, the antenna 1006 may be coupled to the feedthrough 1008 via the antenna lead 1012. The feedthroughs 1008 may include several parts as described herein. Further, each of the seals 1010 may include a glass frit which is positioned at least in part within an orifice through which the feedthroughs 1008 pass. A main cavity 1022 may be filled with an internal mixture and a suitable buffer gas. The internal mixture can include, for example, a salt, an amalgam, etc. The suitable buffer gas, may include, a Noble gas such as, for example, one or more of Argon, Xenon, Neon, and/or combinations thereof, etc.

Advantages of the present system include an antenna lead and/or the antenna which may be capable of resisting high operation temperatures which are generated when operating a lamp according to the present system. Further, the preset embodiment provides for an active antenna which is substantially or fully integrated with the lamp such that elements such as, for example, wires, etc., may not be necessary to couple a feedthrough to an antenna. Further, the antenna lead may include a conductive coating which may be directly coupled to the feedthrough.

According to one aspect of the present system, an antenna lead may be formed at various times. For example, the antenna lead may be formed using a conductive coating deposited by, for example, dipping, spraying, dispensing, etc., material upon any desired parts of the lamp after a second sealing process is performed. The antenna lead may be formed integrally with a main part and/or rings of an antenna. Further, the main part and/or rings of the antenna may be formed using conventional methods and the antenna lead may be formed using a conductive coating. Accordingly, an antenna lead may electrically connect an antenna according to the present system to an electrode. The antenna and/or the antenna lead may be formed from a suitable conductive material that may be temperature stable at approximately 1000° C. to 800° C. Suitable materials may include, for example, metal coatings and/or transparent conductive coatings such as, for example, ATO (Antimony Tin Oxide), ITO (Indium Tin Oxide), FTO (Fluorine Tin Oxide), etc. A suitable coating may include coatings which may be temperature stable over the lifespan of a bulb.

To lower hot-restrike voltages, a lamp, such as, for example, lamp 600, may include an outer gas filling in the cavity 622 in which the lamp 642 is located. The lamp 642 may include lamps as described elsewhere in this document. The outer gas filling may include suitable gases such as, for example, air, nitrogen (N), Xenon (Xe), Argon (Ar), Nitrogen (N), Krypton (Kr), and/or combinations thereof. Suitable pressures may include pressures within the range of substantially 50 to 2000 mBar. For example, an outer gas filling may have a pressure range that is roughly between 200 mBar and one (1) Bar. However, other ranges are also envisioned. When using a fill and an antenna according to the present system, a hot-restrike voltage may be lowered by about 25% as compared with conventional lamps.

Figure 11:
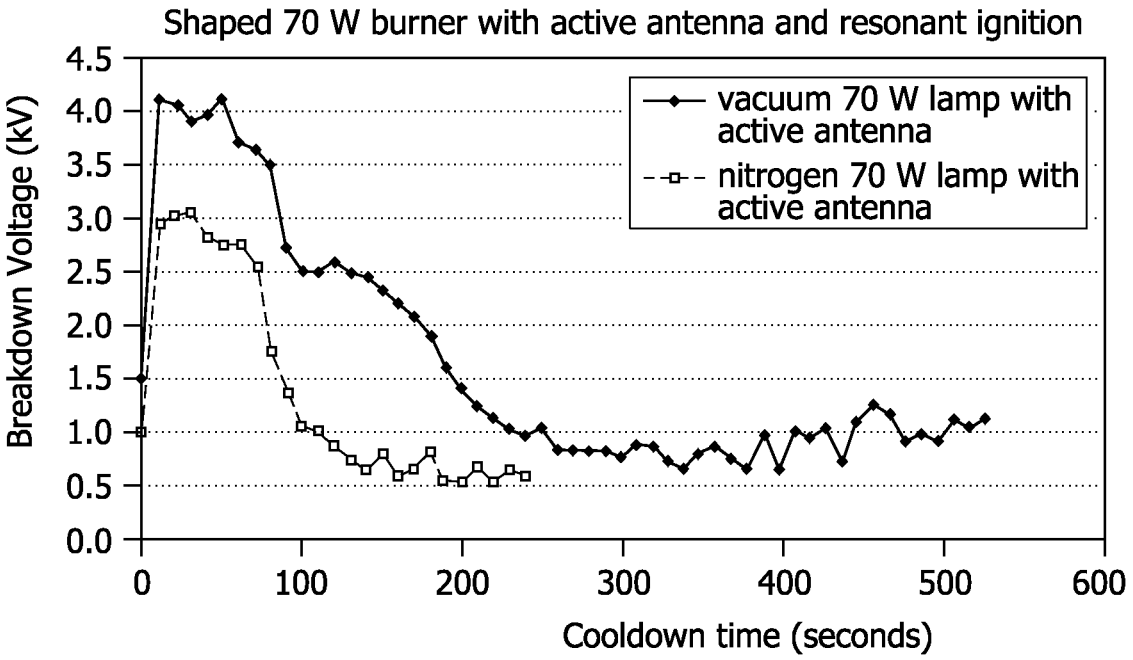
FIG. 11 is a graph illustrating breakdown voltage with respect to cooldown time for a 70 W lamp according to an embodiment of the present system.

A graph illustrating breakdown voltage with respect to cooldown time for a 70 W (CDM) lamp according to an embodiment of the present system is shown in FIG. 11. As shown in graph 1100, a 70 W lamp having an outer gas fill which includes, for example, Nitrogen at one (1) bar has a lower breakdown voltage than that of a similar 70 W lamp which uses a vacuum rather than the Nitrogen gas under one (1) bar of pressure. The lamp may be similar to lamp 600 and the gas fill may be located in a cavity such as, for example, cavity 622.

Figure 12:
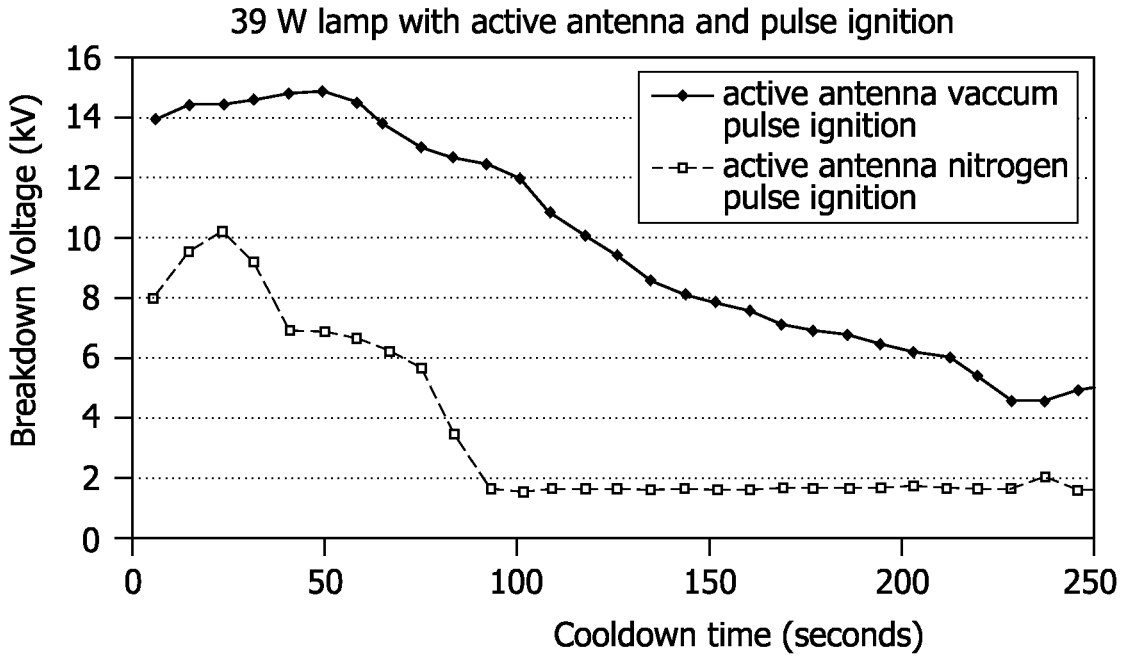
FIG. 12 is a graph illustrating breakdown voltage with respect to cooldown time for a 39 W lamp according to an embodiment of the present system.

A graph illustrating breakdown voltage with respect to cooldown time for a 39 W lamp according to an embodiment of the present system is shown in FIG. 12. As shown in graph 1200, a 39 W lamp having an outer gas fill which includes, for example, Nitrogen at one (1) bar has a lower breakdown voltage than that of a similar 39 W lamp which uses a vacuum rather than the Nitrogen gas under one (1) bar of pressure.

Figure 13:
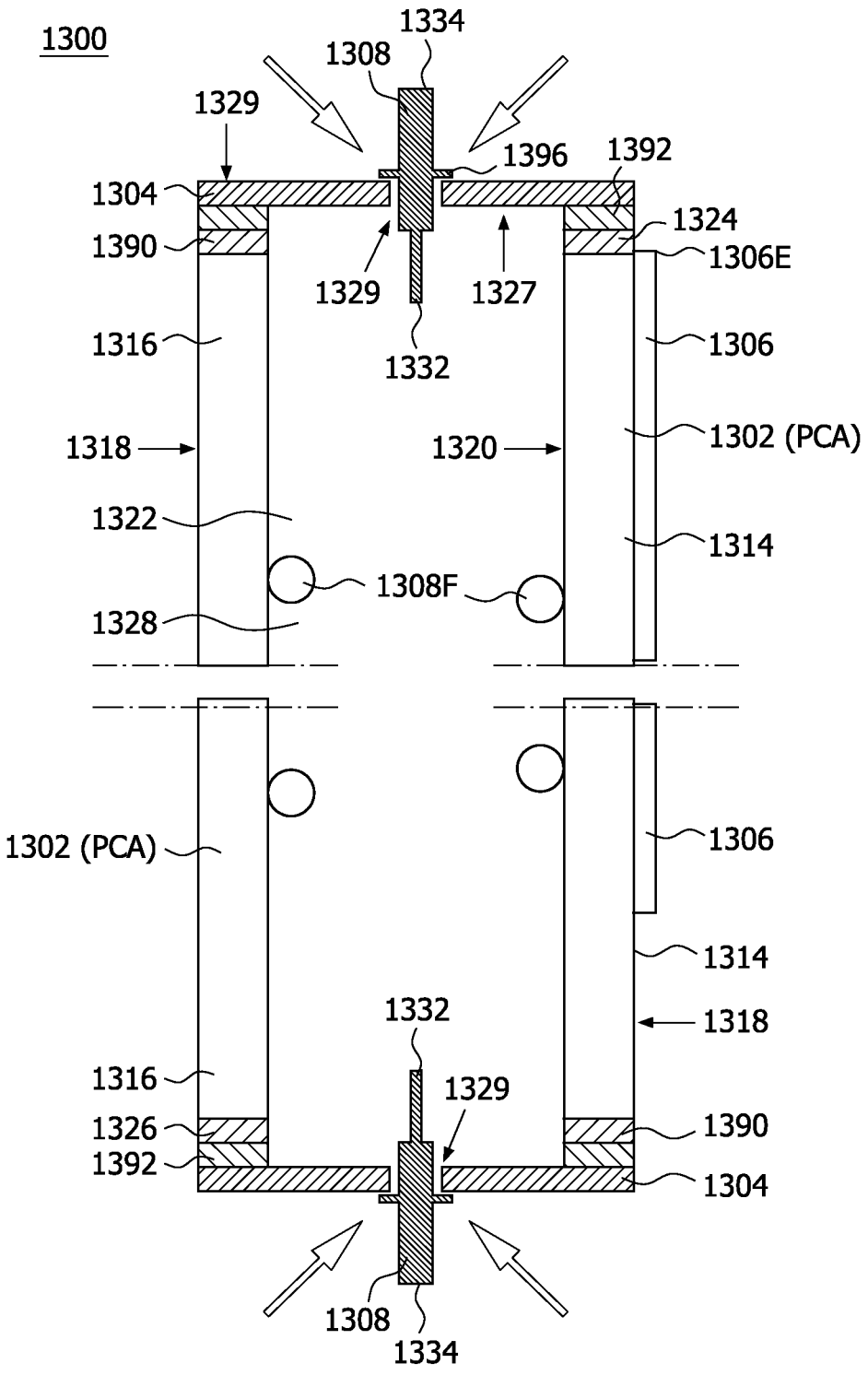
FIG. 13 is a partially-exploded cross-sectional view illustration of an exemplary HPS lamp having an integrated hybrid antenna according to another embodiment of the present system.

A partially-exploded cross-sectional view illustration of an exemplary HPS lamp having an integrated hybrid antenna according to another embodiment of the present system is shown in FIG. 13. The lamp 1300, may include one or more of an arc tube, e.g., PCA tube (hereinafter tube) 1302, end caps 1304, an antenna 1306, one or more feedthroughs 1308.

The tube 1302 may be formed from polycrystalline alumina (PCA) or other suitable material. The tube 1302 has first and second ends 1324 and 1326, respectively, and an optional cylindrical shape with a center portion 1314 situated between end portions 1316. The end portions 1316 may have a diameter that is larger than the diameter of the center portion 1314. However, it is also envisioned that the diameter of one or more of the end portions 1316 may be smaller than, or equal to, the diameter of the center portion 1314. The tube 1302 has outer and inner walls 1318 and 1320, respectively, with the inner wall 1320 defining at least part of a main cavity 1322. Although a cylindrical tube 1302 is shown, it is also envisioned that the tube may have other shapes such as, for example, oval, bulbous, etc. Further, although the cross section of the tube 1320 is circular in cross section, it may have other shapes.

The tube 1302 may optionally include a one or more cermet layers 1390 (e.g., Mo—$Al_2O_3$ and/or W—$Al_2O_3$ are examples which may be used) at the first and second ends 1324 and 1326, respectively, of the tube 1302 and/or one or more braze layers 1392. The braze layer 1392 may be deposited upon, and/or be attached to, an adjacent cermet layer 1390 when present. The one or more cermet layers 1390 and/or the one or more braze layers 1392 are conductive such as at least one of IrTa, IrNb, RhTa, RhNb, PtTa, PtNb, PdTa, PdNb, etc., for example.

The end caps 1304 may have inner and outer walls 1327 and 1329, respectively, and button holes 1323 which may extend between the inner and outer walls 1327 and 1329, respectively. The end caps 1304 may be situated at opposite ends of the tube 1302 such that a gas cavity 1328 is situated therebetween. The end caps 1304 may have an outer periphery which may be flush with an outer periphery of the end portions 1316 of the tube 1302 or may slightly protrude beyond the extend beyond the outer periphery of the end portions 1316 of the tube 1302, if desired. The end caps 1304 may be formed from any suitable conductive material may be coupled to an adjacent feedthrough 1308 of the feedthroughs 1308. Additionally, one or more of the end caps 1308 may be coupled to an adjacent braze layer 1392 of the braze layers 1392.

The one or more feedthroughs 1308 may include first/inner and second/outer ends 1332 and 1334, respectively, an optional electrode coil (which is made from a suitable material such as, for example, Tungsten (W)) may be situated proximate to the first/inner ends 1332 of the feedthroughs 1308, and/or a flange 1396 which is shaped and sized such that it is suitable for holding a corresponding feedthrough 1308 in a desired position. Each of the feedthroughs 1308 may be attached to a corresponding end cap 1304 using any suitable method to form a seal therebetween so that gas contained within the gas cavity 1328 may be prevented from escaping. Suitable sealing methods may include, for example, a weld (e.g., a laser formed weld, etc.), etc. The laser weld may extend about an outer periphery of, for example, the flange 1396 of a corresponding feedthrough 1308. Likewise, a suitable seal should be formed between the one or more end caps 1304 and the tube 1302 so that gas is prevented from escaping from the main cavity 1322. Accordingly, the one or more end caps 1304 may be sealed to an adjacent braze layer 1392 using, for example, a gas impermeable seal. It is also envisioned that a frit such as, for example, a glass frit, may be located between the one or more feedthroughs 1308 (e.g., Nb and/or Mo) and an adjacent end cap 1304 (e.g., Nb and/or Mo).

One or more of the feedthroughs 1308 may be formed using two or more parts. For example, a first part may be situated proximate to the first end 1332 and a second part may be situated, for example, proximate to the second end 1334. The first part may include (or be formed from) a material such as, for example, Tungsten and the second part may include (or be formed from) a material such as, for example, Niobium (Nb). The first part and the second part may be attached to each other, or may be coupled to each other using other parts which may include other materials. For example, these other parts may include cermet and/or molybdenum and be situated between the tungsten and niobium areas of the feedthrough. The arc tube 1300 and portions thereof, e.g., tube 1302 and one or more of the feedthroughs 1308, may have any desired shape and cross-sections, such as cylindrical, rectangular, etc.

The antenna 1306 may extend along a longitudinal part of the tube 1302. The antenna 1306 may include various shapes and sizes, as desired. For example, the antenna 1306 may include end rings which may fully (or partially, if desired) encircle the tube 1302, and an antenna lead which may be coupled to one of the end rings, and/or to the cermet or bronze layers, 1390 and 1392, respectively.

The antenna lead may couple the antenna 1306 to an adjacent end cap 1304. Accordingly, an end 1306E of the antenna lead may extend to an adjacent end cap 1304 or may extend to one or more of the cermet and/or braze layers 1390 and 1392, respectively.

Interior portions of the cavity 1322 may be filled with an internal mixture and a suitable buffer gas. The internal mixture can include, for example, a salt, an amalgam, etc. The suitable buffer gas, may include, a Noble gas such as, for example, one or more of Argon, Xenon, Neon, and/or combinations thereof, etc., at a pressure of substantially between 50 and 720 torr.

Figure 14:
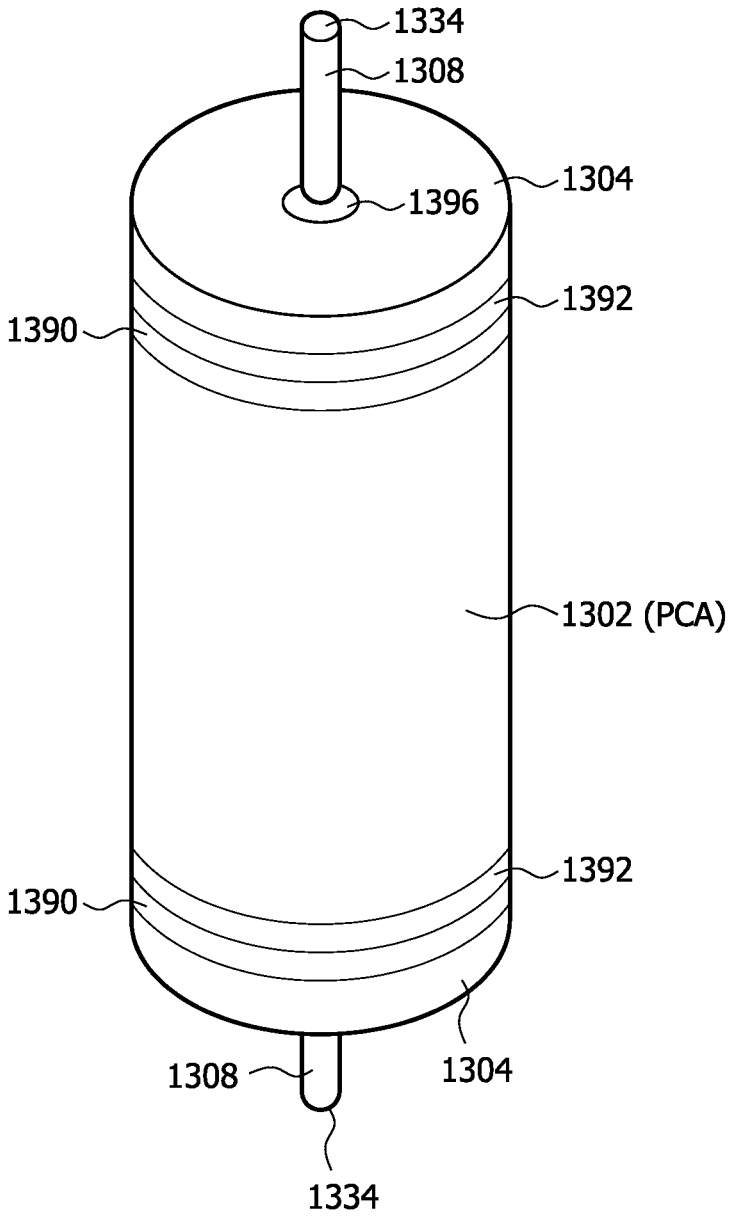
FIG. 14 is a perspective-view illustration of the lamp shown in FIG. 13.

FIG. 14 is a perspective-view illustration of the lamp shown in FIG. 13. The tube 1302 and one or more feedthroughs 1308, may have any desired shape and cross-sections, such as cylindrical, rectangular, etc.

Figure 15:
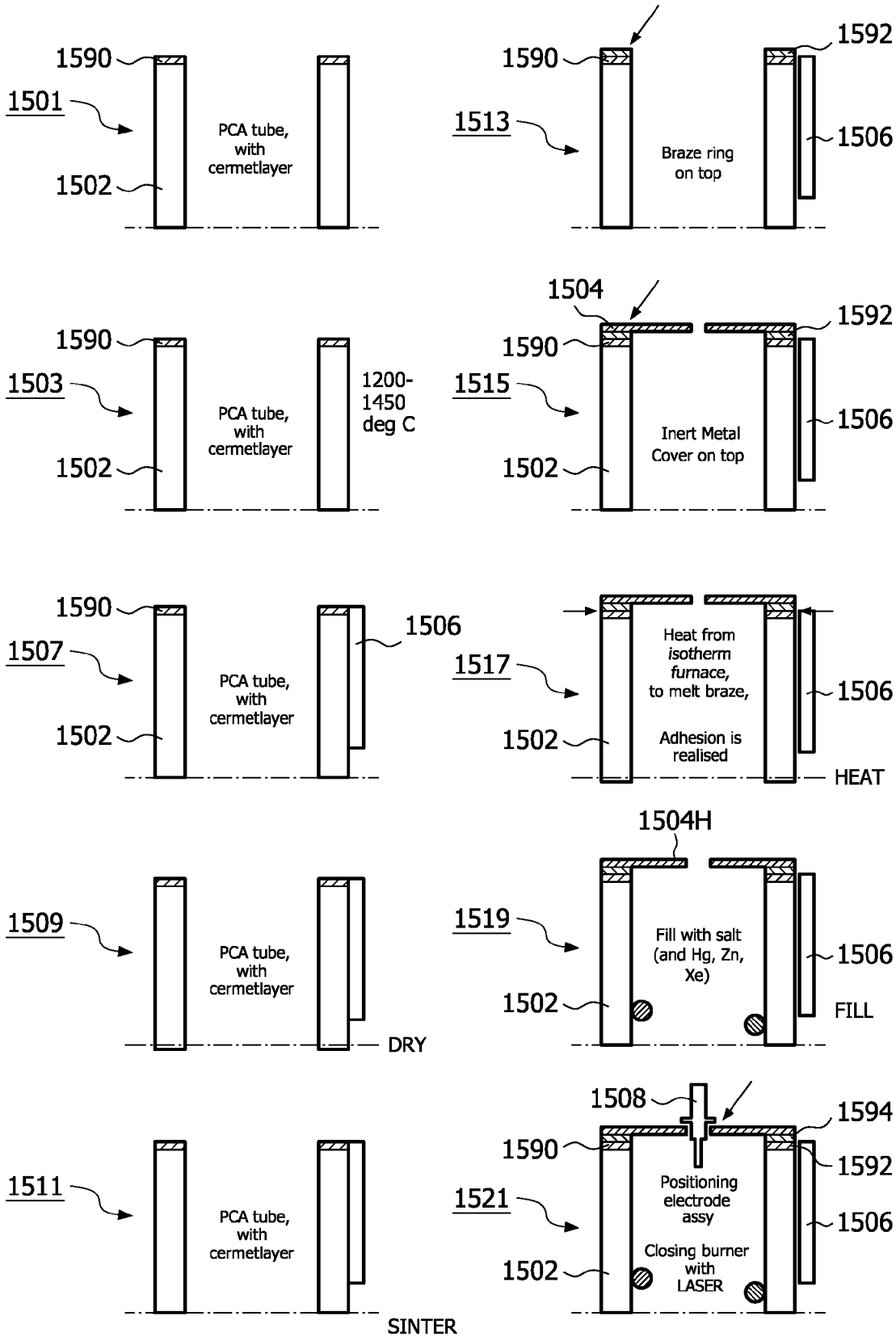
FIG. 15 illustrates a process for forming the lamp 1300 according to the present system.

A process for forming the lamp of FIGS. 13-14 will now be described. A process for forming the lamp 1300 according to the present system is shown in FIG. 15. Process 1500 may be controlled by one more computers communicating over a network (not shown). The process 1500 may include one or more of the following steps, acts or operations. Further, one or more of these acts may be combined and/or separated into sub-acts, if desired.

In act 1501, a tube 1502 is formed using a material such as, for example, an alumina material. The tube 1502 may be formed using any suitable method such as, for example, extrusion, injection molding, slip casting, etc. The cermet layer 1590 may formed by deposited cermet upon a 'brown' PCA. After completing act 1501, the process continues to act 1503.

In act 1503, the alumina is subjected to air firing at 1200-1450 degrees C. (or other suitable temperature) so as to burn organic binders from the formed shape of the tube and/or to densify the material so that the formed shape maintains its integrity during application of a tungsten antenna material in act 1507. After baking out the tube 1502, the cermet layer 1590 may be highly conductive. After completing act 1503 and allowing the tube to cool, the process continues to act 1507.

In act 1507, an antenna 1506, or parts thereof (e.g., an antenna lead), is formed by applying a tungsten trail along an exterior portion of the tube 1502 so that the tungsten trail extends to, and makes contact with, the cermet layer 1590. The antenna 1506 may be formed by depositing a mixture such, as, for example, $Al_2O_3$ and W on a 'brown' PCA tube. Thereafter, by baking out, the W becomes metallic. This act is similar to act 506 of process 500. It is also envisioned that the antenna 1506 may be made using the same, or similar, material as the cermet layer 1590. After completing act 1507, the process continues to act 1509.

In act 1509, organics from the tungsten paste are dried and the process continues to act 1511.

In act 1511, the tube is subject to a sintering process as described in act 514 of process 500. After completing act 1511, the process continues to act 1513.

In act 1513, a braze layer 1592 is placed and/or deposited upon the cermet layer 1590. The process then continues to act 1515.

In act 1515, an end cap 1504 may be placed upon the braze layer 1592. The end cap is preferably made from a metal or other suitable conductive material. After completing act 1515, the process continues to act 1517.

In act 1517, the end cap 1504 is attached to the tube 1502 by melting the braze layer 1592 using any suitable method. For example, the assembly formed by the tube 1502, the cermet layer 1590, the braze layer 1592, and/or the end cap 1504 may be subject to heat from an isotherm furnace that is sufficient to melt the braze layer 1592. Thereafter, when the assembly is cooled, adhesion is realized and the end cap 1504 remains fixedly attached to the tube 1502. After completing act 1517, the process continues to act 1519.

In act 1519, an internal mixture and a suitable buffer gas are placed within the cavity of the tube 1502. The internal mixture can include, for example, a salt, an amalgam, etc. The suitable buffer gas, may include, a Noble gas such as, for example, one or more of Argon (Ar), Xenon (Xe), Neon (Ne), and/or combinations thereof, etc. The internal mixtures of salt, amalgam, etc., may be placed into the cavity through one or more holes 1504H in one or more of the end caps 1504. However, it is also envisioned that the internal mixtures may be placed into the tube via an open end of the tube and then an end part (which can include a feedthrough) can be connected to the tube using any suitable method. The process then continues to act 1521.

In act 1521, an electrode assembly (i.e., a feedthrough) 1508 may be inserted into each hole of the end caps 1504 and sealed to a corresponding end cap using any suitable method such, as, for example, laser welding such that a desired pressure may be maintained within the cavity. The electrode assembly 1508 is now electrically coupled to the antenna 1506 via one or more of the end cap 1504, the corresponding braze layer 1592, and the cermet layer 1590 that is adjacent to the tungsten antenna lead. The lamp assembly is now complete and may be used "as is" or incorporated within a lamp assembly as shown in FIG. 6.

Figure 16:
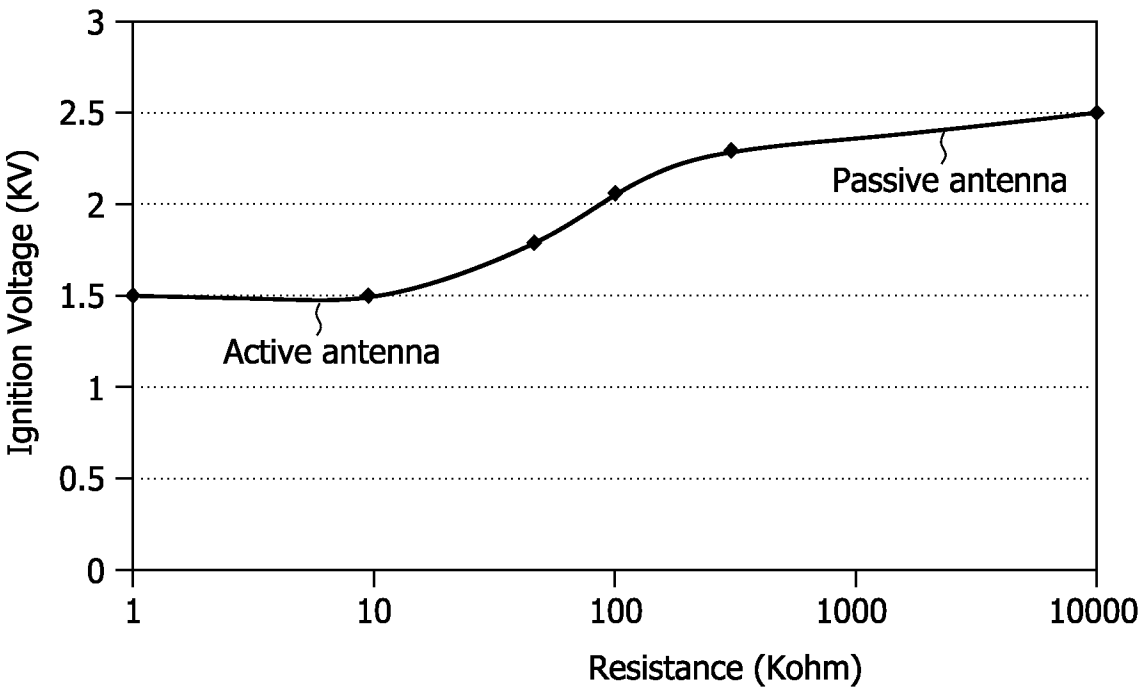
FIG. 16 is a graph illustrating ignition voltage as a function of resistance between an electrode and an antenna.

A graph illustrating ignition voltage as a function of resistance between an electrode and an antenna is shown in FIG. 16 (the diamonds are measuring points). Resistance between an electrode and an antenna may be dependent upon one or more variables, such as, for example, conductivity of an optional frit, distance between an electrode and an antenna (e.g., a thickness of the frit 810 shown in FIG. 8A and/or the distance between the end 213A of the antenna 212A and the feedthrough 208), etc. By changing these variables, the antenna can go from an active antenna, to a passive antenna when the resistance increases from 10 kohms to 1000 kohms, for example. A bulb incorporating an antenna according to the present system may require a higher ignition voltage when using a passive antenna as opposed to an active antenna.

An impedance Z between, for example, a Nb feedthrough and the antenna of a lamp according to the present system may be a dependent upon resistance R and capacitance C and, may be determined using, for example, Equation 1 below.

$$Z = R + \frac{1}{j \cdot 2\pi \cdot j \cdot C} \qquad \text{Eq. (1)}$$

where f denotes a frequency of an ignition waveshape that may be provided to the lamp. Accordingly, in a discharge lamp such as, for example, an HPS-type lamp, the resistance (and thus the conductivity) between of the antenna and the electrode may be determined by one or more factors such as, for example, a thickness of a frit, a quality of the frit, and a frequency of an igniter which may supply an ignition waveshape to the lamp. This determines if an antenna is active or passive, and thus the height of the breakdown voltage. So when the antenna is in direct contact with the electrode (and thus is an active antenna) the breakdown will be low. When the antenna is not in direct contact with the electrode because of the frit material, for example, then the thickness and the conductivity of the frit material determines if an antenna is active or passive.

According to present system, it is envisioned that a lamp according to an embodiment of the present system may operate with a high frequency (HF) ignition waveshape that may have a frequency that is, for example, between 25 and 600 kHz that may be provided by a HF igniter. However, it is also envisioned that a lamp according to the present system may operate with an ignition waveshape that has higher or lower frequency.

According to yet another embodiment of the present system a lamp, such as any discharge lamp, whether HPS or non-HPS lamps, may include a tube which may provide a seal about a feedthrough. Accordingly, a lamp may be produced without one or more of a frit and/or a button (e.g., see buttons or plugs 204 and one or more fits 210, FIG. 3). Thus, an end part of a tube (e.g., a PCA) of the lamp may be sealed about an adjacent feedthrough so as to contain a gas contained within a cavity of the tube. Accordingly, the feedthrough may be in contact with a part of the tube and/or an adjacent antenna lead (which may depend upon whether a passive or an active antenna is used). A lamp according to the present embodiment will now be illustrated with reference to FIGS. 17-20.

Figure 17:
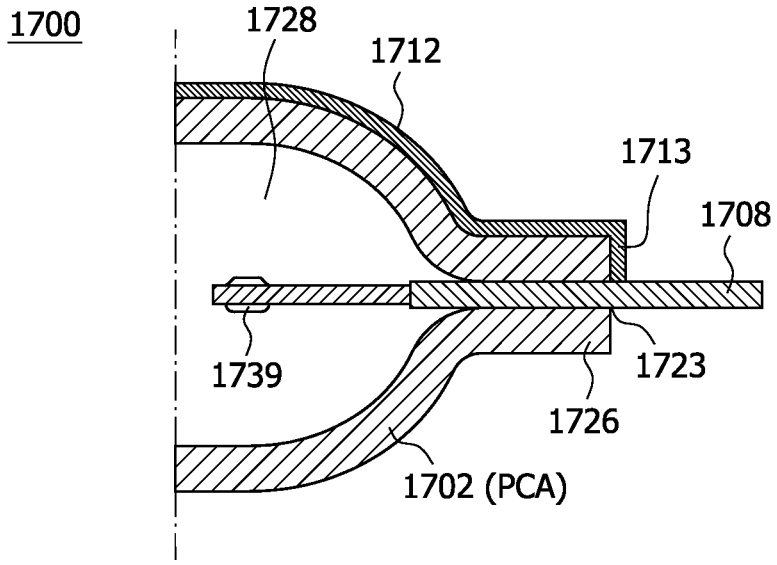
FIG. 17 is a detailed partial cross sectional view illustration of an end of a lamp including an integrated hybrid antenna according to another embodiment of the present system.
Figure 20:
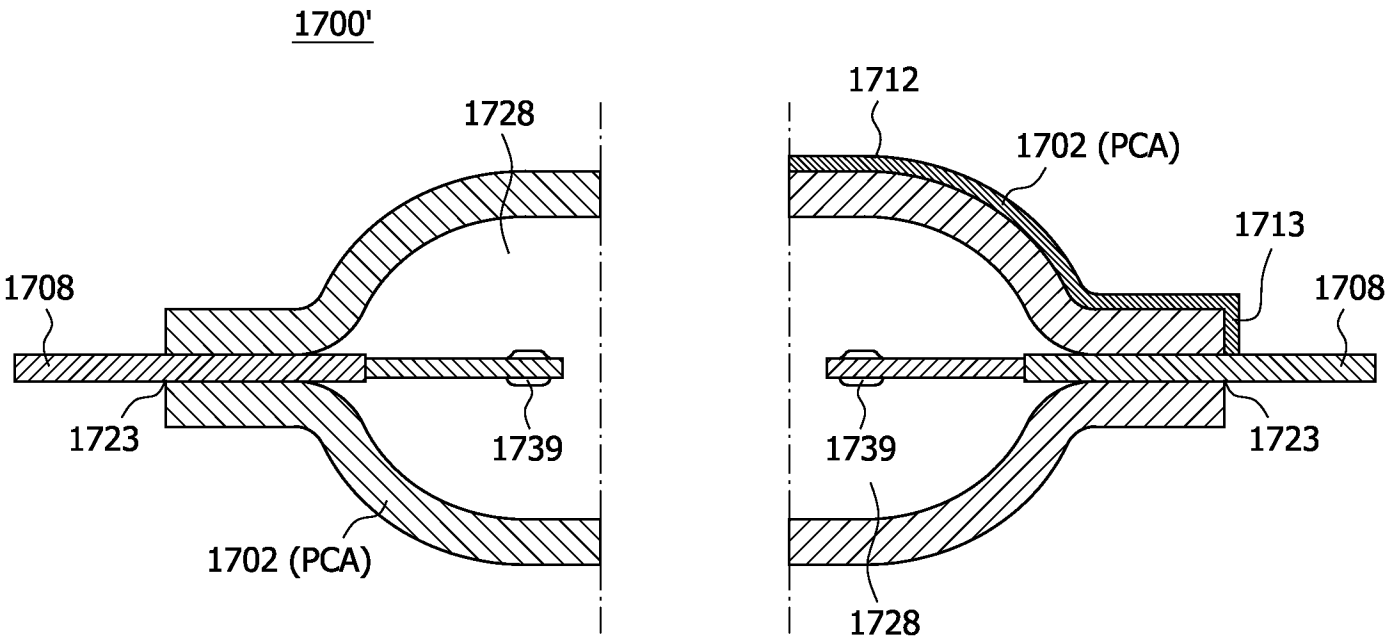
FIG. 20 is a detailed cross sectional view illustration of the lamp shown in FIG. 17.

A detailed partial cross sectional view illustration of an end of a lamp 1700 including an integrated hybrid antenna according to another embodiment of the present system is shown in FIG. 17, where both ends of the lamp 1700 are shown in FIG. 20 as lamp 1700'.

The lamp 1700 may include one or more of a tube 1702, an antenna 1712, and one or more feedthroughs 1708.

The tube 1702 may include any suitable material such as, for example, PCA, and may include one or more shaped ends 1726 each of which may define an opening (or hole) 1723 in which a corresponding feedthrough 1708 may be situated. The tube 1702 may include a gas or discharge cavity 1728 which may include a desired fill suitable for providing illumination. Further, the fill may include one or more of a salt, an amalgam, and a gas such as, for example, a buffer gas, etc.

The gas may include any suitable gas or gas mixture such as, for example, Argon (Ar), Xenon (Xe), Neon (Ne), and/or combinations thereof. The tube 1702 may form a seal around a corresponding feedthrough 1708 so that the fill may be prevented from escaping from the gas cavity 1728.

The one or more feedthroughs 1708 may include an optional electrode coil 1739 (e.g., of Tungsten, etc.) that may be situated within the gas cavity 1728. The one or more feedthroughs 1708 may be constructed from any suitable material or materials and may be similar to feedthroughs described elsewhere in this document (e.g., see, feedthrough 208, FIG. 2, etc.). Accordingly, for the sake of clarity, a further description of the one or more feedthroughs 1708 will not be provided.

The antenna 1712 may include an end 1713 which may be electrically coupled to one of the one or more feedthroughs 1708 so as to provide an active antenna. Accordingly, the end 1713 of the antenna 1712 may be located at, or on, an adjacent feedthrough 1708 such that an electrical contact may be established. The antenna 1712 may include any suitable shape and/or size. Further, the antenna 1712 may be formed from any suitable material (e.g., Tungsten, etc.) and situated upon the tube 1702 as described elsewhere in this document. Accordingly, a further description of the antenna 1712 will not be provided. The antenna 1712 may extend for any suitable length. For example, the antenna 1712 may extend over the extended plug (e.g., see plug 204 in FIG. 2). The antenna 1712 may be formed from an electrically conductive material such as, for example, tungsten that is deposited upon the tube 1702 (e.g., the PCA) before a sintering the tube 1702. However, it is also envisioned that the antenna (or parts thereof) may be deposited upon the tube 1702 after the tube has been sintered. The antenna 1712 may include one or more rings that may encircle at least part of an outer body wall of the tube 1702.

In other embodiments, it is envisioned that a passive antenna may be provided by passively coupling the antenna end 1713 to an adjacent one of the one or more feedthroughs 1708. For example, a passive (or indirect) coupling may be obtained by situating the end 1713 of the antenna 1712 apart from an adjacent feedthrough 1708. Further, the antenna end 1713 may, for example, form any suitable shape. For example, the antenna end 1713 may extend to form a ring around (with or without electrically touching, dependent upon whether an active or passive antenna may be provided,) an adjacent one of the one or more feedthroughs 1708. It is also envisioned that the antenna end 1713 may be formed on an end of the tube 1702 and/or in the hole or opening 1723 such that the end 1713 of the antenna 1712 may fully or partially encircle the feedthrough 1708. It is also envisioned that an electrically conductive material may be deposited to electrically connect the antenna 1712 (or portions thereof) to an adjacent one of the one or more feedthroughs 1708.

Figure 18:
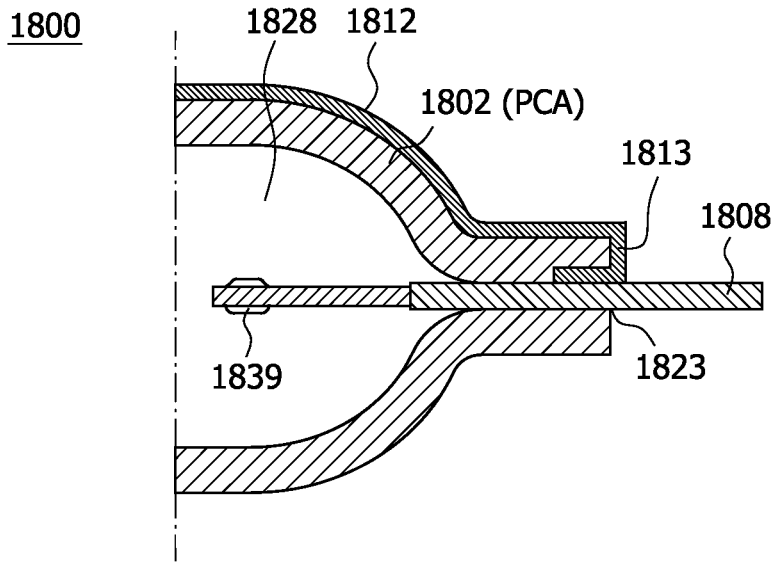
FIG. 18 is a detailed partial cross sectional view illustration of an end of a lamp including an integrated hybrid antenna according to a further embodiment of the present system.

A detailed partial cross sectional view illustration of an end of a lamp 1800 including an integrated hybrid antenna according to a further embodiment of the present system is shown in FIG. 18. The lamp 1800 may include one or more of a tube 1802, an antenna 1812, and one or more feedthroughs 1808. The lamp 1800 may be similar to the lamp 1700 (shown in FIG. 17) however, an end 1813 of an antenna 1812 may extend into an opening (or hole) 1823 of the tube 1802 so as to electrically couple the antenna 1812 to an adjacent feedthrough 1808 of one or more feedthroughs 1808. Further, the end 1813 of the antenna 1812 may include a pad having a larger surface area than provided by the antenna end 1813 of FIG. 18 so as to electrically connect the antenna 1812 to an adjacent one of the one or more feedthroughs 1808. It is also envisioned that the end 1813 of the antenna 1812 may encircle the feedthrough 1808.

Figure 19:
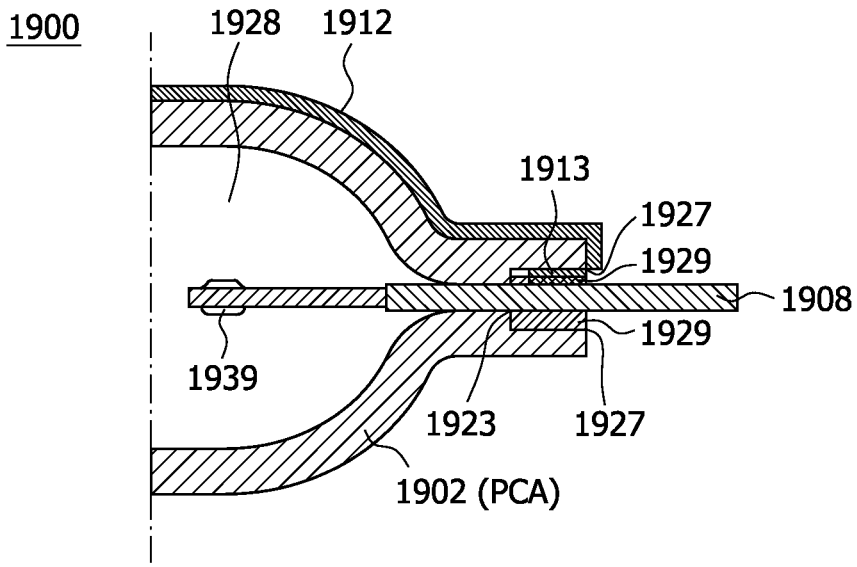
FIG. 19 is a detailed partial cross sectional view illustration of an end of a lamp including an integrated hybrid antenna according to yet a further embodiment of the present system.

A detailed partial cross sectional view illustration of an end of a lamp 1900 including an integrated hybrid antenna according to yet a further embodiment of the present system is shown in FIG. 19. The lamp 1900 may include one or more of a tube 1902, an antenna 1912, and one or more feedthroughs 1908. The lamp 1900 may be similar to the lamp 1800 (shown in FIG. 18) however, an end opening 1927 may be formed between the tube 1902 and the feedthroughs 1908 or portions of the feedthroughs 1908 after sintering, where the feedthroughs 1908 is located through the tube opening 1923 (of the tube 1902). In this case, the end opening 1927 would prevent a connection between the electrode 1939 or feedthroughs 1908 and the antenna 1912. Thus, to provide a connection between the feedthroughs 1908 and the antenna 1912, a conductive coating 1929, e.g. metal coating (of tungsten and/or the like) is provided after sintering between the PCA tube 1902 and the feedthroughs 1908. Accordingly, as shown in FIG. 19, the end 1913 of the antenna 1912 extends into the tube opening (or hole) 1923 of the tube 1902. At least part of the antenna 1912 and/or the electrically conductive material (e.g., tungsten) 1929 may be placed in at least part of the end opening 1927 (that separates the PCA tube 1902 from the feedthroughs 1908) so as to electrically couple the antenna 1912 to an adjacent feedthrough 1908 of one or more feedthroughs 1908. The end 1913 of the antenna 1912 may fully or partially encircle an adjacent one of the one or more feedthroughs 1908 and/or may extend into other parts of the opening 1923 of the tube 1902. The electrically conductive material 1929 may be situated between the antenna 1912 and the adjacent one of the one or more feedthroughs 1908. Further, the end 1913 of the antenna 1912 may provide a pad having a larger surface area to electrically connect to the antenna 1912 than provided by the end 1713 of the antenna 1712 of FIG. 17.

A detailed cross sectional view illustration of the lamp shown in FIG. 10 is shown in FIG. 13. The antenna 1012 may be coupled to a feedthrough of the one or more feedthroughs 1008.

A further feature of the present systems and devices is to provide an HPS-type lamp which may be filled with a higher gas (e.g., Xe) pressure so as to enhance luminous efficiency and photon flux values of the HPS-type lamp, and reduce the operating wall temperature of the PCA arc tube, as shown in FIG. 7, thus prolonging life while using conventional lighting fixture components. Thus, conventional lamps in, for example, commercial settings such as, greenhouses, may be easily updated to provide enhanced lighting levels thereby increasing plant growth and gains in efficiency.

Certain additional advantages and features of this invention may be apparent to those skilled in the art upon studying the disclosure, or may be experienced by persons employing the novel system and method of the present invention, chief of which is that a more reliable and easily started HPS/CDM lamps, or the like, which may be operated using conventional fixture components is provided. Another advantage of the present systems and devices is that conventional lamps can be easily upgraded to incorporate the features and advantages of the present systems and devices.

For example, by using an antenna according to the present system, ignition voltage may be lowered. Additionally, by using an integrated antenna according to the present system, a compact lamp may be realized. Moreover, lamp performance may be enhanced by, for example, increasing Xenon (Xe) pressure within an HPS lamp according to the present system without changing ignition voltage.

Of course, it is to be appreciated that any one of the above embodiments or processes may be combined with one or more other embodiments and/or processes or be separated and/or performed amongst separate devices or device portions in accordance with the present systems, devices and methods.

Finally, the above-discussion is intended to be merely illustrative of the present system and should not be construed as limiting the appended claims to any particular embodiment or group of embodiments. Thus, while the present system has been described in particular detail with reference to exemplary embodiments, it should also be appreciated that numerous modifications and alternative embodiments may be devised by those having ordinary skill in the art without departing from the broader and intended spirit and scope of the present system as set forth in the claims that follow. Accordingly, the specification and drawings are to be regarded in an illustrative manner and are not intended to limit the scope of the appended claims.

In interpreting the appended claims, it should be understood that:

a) the word "comprising" does not exclude the presence of other elements or acts than those listed in a given claim;

b) the word "a" or "an" preceding an element does not exclude the presence of a plurality of such elements;

c) any reference signs in the claims do not limit their scope;

d) several "means" may be represented by the same item or hardware or software implemented structure or function;

e) any of the disclosed elements may be comprised of hardware portions (e.g., including discrete and integrated electronic circuitry), software portions (e.g., computer programming), and any combination thereof;

f) hardware portions may be comprised of one or both of analog and digital portions;

g) any of the disclosed devices or portions thereof may be combined together or separated into further portions unless specifically stated otherwise;

h) no specific sequence of acts or steps is intended to be required unless specifically indicated; and i) the term "plurality of" an element includes two or more of the claimed element, and does not imply any particular range of number of elements; that is, a plurality of elements may be as few as two elements, and may include an immeasurable number of elements.

What is claimed is:

1. A discharge lamp comprising:

a body portion having inner body and outer body walls and first and second ends, the inner body wall defining at least part of a cavity located between the first end and the second end;

first and second end parts having inner end-part and outer end-part walls and a hole extending between the inner end-part wall and the outer end-part wall, the first and second end parts each being located, at least in part, within the cavity and separate from each other so as to maintain a gas under pressure;

first and second electrodes in the cavity; and an antenna having first and second antenna ends including a continuous portion formed on the outer body wall of the body portion and the outer end-part wall of one of the first and second end parts, wherein the antenna is not directly connected to the first and second electrodes, wherein the continuous portion of the antenna is further formed on the inner body wall of the body portion.

2. The discharge lamp of claim 1, wherein the antenna has a potential which floats relative to the first and second electrodes.

3. The discharge lamp of claim 1, wherein the antenna is capacitvely coupled to the first and second electrodes.

4. The discharge lamp of claim 1, wherein the antenna comprises tungsten.

5. The discharge lamp of claim 1, wherein the first end of the antenna extends at least partially into the hole of the first end part or the second end part upon which the antenna is formed.

6. The discharge lamp of claim 1, further comprising at least one frit located, at least in part, within the hole of a corresponding one of the first and second end parts.

7. The discharge lamp of claim 6, wherein the at least one frit is in contact with the antenna.

8. The discharge lamp of claim 6, wherein the antenna is capacitvely or resistively coupled to the first and second electrodes through the at least one frit.

9. The discharge lamp of claim 8, further comprising one or more feedthroughs having first and second ends and located, at least in part, through the hole of a corresponding one of the first or second end parts, wherein one of the one or more feedthroughs is in contact with the frit that is in contact with antenna.

10. The discharge lamp of claim 1, further comprising a feedthrough which passes though the hole of one of the first end part or the second end part and is separated from the first end of the antenna by a distance of between 20 and 100 microns.

11. The discharge lamp of claim 1, wherein the cavity is filled with a mixture comprising a salt, an amalgam, and a buffer gas, the buffer gas comprising one or more of Argon, Xenon, Krypton, and Neon at a pressure of between 22 and 1000 torr.

12. A discharge lamp apparatus, comprising:

a body portion having an outer body wall and an inner body wall, the inner body wall defining at least part of a main cavity;

first and second end parts having inner and outer sides and a hole which extends between the inner side and the outer side, the first and second end parts being situated at least partially within the main cavity;

first and second feedthroughs, the first feedthrough being located, at least in part, within the hole of the first end part, and second feedthrough being located, at least in part, within the hole of the second end part, the first feedthrough and the second feedthrough being configured to pass a current though the respective hole in which the corresponding feedthrough is located;

first and second electrodes in the cavity connected to the first and second feedthroughs; and an antenna having first and second antenna ends, the first antenna end being located in the hole of the first end part, and the second antenna end being located on a part of the body portion which is between the first end part and the second end part, the antenna being continuously formed on at least the outer wall of the body portion, the outer side the first end part, and the inner body wall of the body portion; and first and second frits which position the feedthroughs relative to the body portion, the first frit being positioned between the first antenna end of the antenna and a corresponding one of the feedthroughs, wherein the antenna is not directly connected to the first and second electrodes.

13. The discharge lamp of claim 12, wherein the antenna has a potential which floats relative to the first and second electrodes.

14. The discharge lamp of claim 12, wherein the antenna is capacitvely coupled to the first and second electrodes.

15. The discharge lamp of claim 12, wherein an area of a part of the antenna which is formed on the first end part is less than an area of the outer side of first end part.

16. The discharge lamp of claim 15, wherein the antenna comprises tungsten.

17. The discharge lamp of claim 15, further comprising a gas cavity situated at least in part within the main cavity between the first and second end parts, the gas cavity being filled with a mixture comprising a salt, an amalgam, and a buffer gas, the buffer gas comprising one or more of Argon, Xenon, and Neon.

18. The discharge lamp of claim 12, wherein an exterior portion of the first feedthrough which is closest to the antenna is separated from the first end of the antenna by a distance of between 20 and 100 microns.

19. A lighting apparatus, comprising:

a base;

an outer bulb attached to the base and forming an inner cavity;

a frame situated within the inner cavity, the frame comprising first and second parts which are configured and arranged to conduct a current and position a gas discharge tube; and the gas discharge tube comprising:

a body portion defining at least part of gas cavity and having holes leading to the gas cavity, the gas cavity for containing a salt, an amalgam, and a buffer gas, the body portion having inner body and outer body walls and first and second ends, the inner body wall defining at least part of the gas cavity located between the first end and the second end;

first and second end parts having inner end-part and outer end-part walls and a hole extending between the inner end-part wall and the outer end-part wall;

first and second feedthroughs having first and second ends and passing through the holes of the body portion such that the second ends of the feedthroughs are situated within the gas cavity and the first ends of the feedthroughs are located outside of the gas cavity and electrically connected to corresponding ones of the first and second parts of the frame;

first and second electrodes in the cavity connected to the first and second feedthroughs;

an antenna formed on an exterior surface of the body portion which is outside of the gas cavity and having an end which is located at a hole of the one or more holes through which the first feedthrough passes; and first and second frits, the first frit being located, at least in part, between the first feedthrough and the antenna so as to separate the antenna from first feedthrough by a predetermined distance, and the second frit locating the second feedthrough in position relative to the body portion, wherein the antenna includes a continuous portion continuously formed on at least the outer body wall of the body portion, the outer end-part wall of one of the first and second end parts, and an inner body wall of the body portion.

20. The lighting apparatus of claim 19, wherein the antenna has a potential which floats relative to the first and second electrodes.

21. The lighting apparatus of claim 19, wherein the antenna is capacitvely coupled to the first and second electrodes.

22. The lighting apparatus of claim 21, wherein the body portion comprises a polycrystalline alumina (PCA), and the antenna comprises tungsten which is formed integrally with the PCA.

23. The lighting apparatus of claim 21, wherein the predetermined distance is between 20 and 100 microns.

24. The lighting apparatus of claim 21, further comprising end parts each having a first side and a second side, wherein the antenna is further formed on the first side of one of the end parts such that an area of that part of the antenna which is formed on the first side of the corresponding end part is less than the area of the first side of the corresponding end part.

25. A discharge lamp comprising:

a body portion having inner and outer body walls and first and second ends, the inner body wall defining at least part of a cavity located between the first end and the second end;

at least one end part which has an inner end-part wall and an outer end-part wall and an orifice extending between the inner end-part wall and the outer end-part wall, wherein the at least one feedthrough passes through the orifice first and second end parts having inner end-part and outer end-part walls and a hole extending between the inner end-part wall and the outer end-part wall;

at least one feedthrough having a first end located within the cavity and a second end outside of the cavity;

at least one frit which holds the at least one feedthrough in a desired position; and an antenna formed on the outer body wall of the body portion and the at least one frit, wherein the antenna includes a continuous portion continuously formed on at least the outer body wall of the body portion, the outer end-part wall of the at least one end part, and the inner body wall of the body portion.

26. The discharge lamp of claim 25, wherein the antenna is formed on, and is connected to, the at least one feedthrough.

27. The discharge lamp of claim 25, wherein the antenna comprises tungsten.

28. The discharge lamp of claim 25, wherein the cavity is filled with a mixture comprising a salt, an amalgam, and a buffer gas, the buffer gas comprising one or more of Argon, Xenon, Krypton, and Neon at a pressure of between 22 and 1000 torr.

29. A discharge lamp comprising:

a body portion having inner and outer body walls and first and second ends, the inner body wall defining at least part of a cavity located between the first end and the second end;

at least one end cap having an inner wall and an outer wall and an orifice situated between the inner and outer walls, the inner wall of the at least one end cap defining at least another part of the cavity;

a conductive layer situated between the first end of the body portion and the at least one end cap;

an antenna formed on the outer body wall of the body portion and having a first end connected to the conductive layer; and at least one feedthrough which passes through the orifice and has a first end located within the cavity and a second end outside of the cavity, wherein the antenna includes a continuous portion continuously formed on at least the outer body wall of the body portion, the outer wall of one of the at least one end cap, and an inner body wall of the body portion.

30. The discharge lamp of claim 29, wherein the conductive layer is situated between the inner body wall and the outer body wall of the body portion such that the conductive layer forms at least part of a ring.

31. The discharge lamp of claim 29, further comprising another conductive layer situated between the conductive layer and the at least one end cap.

32. The discharge lamp of claim 29, wherein the at least one end cap is formed from a conductive material.

33. The discharge lamp of claim 29, wherein the at least one end cap is electrically connected to the antenna.

34. A discharge lamp apparatus, comprising:

a body portion having an outer body wall and an inner body wall, the inner body wall defining at least part of a main cavity and one or more openings extending to the main cavity;

first and second end parts having inner end-part and outer end-part walls and a hole extending between the inner end-part wall and the outer end-part wall;

at least one feedthrough having first and second ends and situated, at least in part, within the one or more openings of the body portion; and an antenna situated on the outer body wall of the body portion and extending to an opening of the one or more openings, wherein the antenna includes a continuous portion continuously formed on at least the outer body wall of the body portion, the outer end-part wall of one of the first and second end parts, and the inner body wall of the body portion.

35. The discharge lamp of claim 34, wherein the antenna has a potential which floats relative to the at least one feedthrough.

36. The discharge lamp of claim 34, wherein the antenna is capacitvely coupled to the at least one feedthrough.

37. The discharge lamp of claim 34, wherein the antenna is electronically connected to the at least one feedthrough.

38. The discharge lamp of claim 34, further comprising a further opening located at the at least one opening, the further opening having an interior wall situated apart from the at least one feedthrough.

39. The discharge lamp of claim 38, wherein the antenna continuously extends from the outer body wall of the body portion to the interior wall of the further opening and is located on the outer body wall and the interior wall of the further opening.

40. The discharge lamp of claim 38, further comprising a filler located in at least part of the further opening and which electrically connects the antenna to the at least one feedthrough.

41. The discharge lamp of claim 34, further comprising a mixture located in the main cavity and comprising a salt, an amalgam, and a buffer gas, the buffer gas comprising a noble gas.

42. The discharge lamp of claim 34, wherein the antenna is separated from the at least one feedthrough by a distance of between 20 and 100 microns.

* * * * *